US008347846B2

(12) United States Patent
Kobayashi et al.

(10) Patent No.: US 8,347,846 B2
(45) Date of Patent: Jan. 8, 2013

(54) CONTROL DEVICE FOR INTERNAL COMBUSTION ENGINE

(75) Inventors: Hideo Kobayashi, Mishima (JP); Toshihisa Sugiyama, Gotenba (JP); Katuhiko Arisawa, Gotenba (JP); Kenichi Yamada, Yaizu (JP); Kunihiko Hayashi, Odawara (JP); Akihito Hosoi, Susono (JP); Syusaku Sugamoto, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 101 days.

(21) Appl. No.: 13/055,117

(22) PCT Filed: Jun. 9, 2009

(86) PCT No.: PCT/JP2009/060523

§ 371 (c)(1),
(2), (4) Date: Jan. 20, 2011

(87) PCT Pub. No.: WO2010/143265

PCT Pub. Date: Dec. 16, 2010

(65) Prior Publication Data

US 2011/0126784 A1 Jun. 2, 2011

(51) Int. Cl.

| | |
|---|---|
| ***F01P 7/14*** | (2006.01) |
| ***F01P 5/10*** | (2006.01) |
| ***F01M 1/02*** | (2006.01) |

(52) U.S. Cl. ..... 123/196 R; 123/41.08; 123/41.44

(58) Field of Classification Search ..... 123/41.08, 123/41.44, 196 R

See application file for complete search history.

(56) References Cited

U.S. PATENT DOCUMENTS

2002/0172604 A1 11/2002 Berger

FOREIGN PATENT DOCUMENTS

| | | | |
|---|---|---|---|
| JP | 63-289213 | A | 11/1988 |
| JP | 64-8511 | A | 1/1989 |
| JP | 3-26255 | A | 3/1991 |
| JP | 06-159029 | A | 6/1994 |
| JP | 06-221127 | A | 8/1994 |
| JP | 2004-150300 | A | 5/2004 |
| JP | 2004-293509 | A | 10/2004 |
| JP | 2004-316472 | A | 11/2004 |
| JP | 2006-214280 | A | 8/2006 |
| JP | 2007-016718 | A | 1/2007 |
| JP | 2007-024013 | A | 2/2007 |
| JP | 2009-209777 | A | 9/2009 |

*Primary Examiner* — Noah Kamen

(74) *Attorney, Agent, or Firm* — Sughrue Mion, PLLC

(57) ABSTRACT

A vehicle control system 10 includes a water pump 23 with an electromagnetic clutch, an oil relief device 25, an OCV 26, a water temperature sensor 31, and an ECU 11. The ECU 11 causes the electromagnetic clutch of the water pump 23 to be disengaged on the basis of the detection result detected by the water temperature sensor 31, and stops the coolant circulation. The ECU 11 instructs the OCV 26 to adjust the lubricant pressure to low by an oil relief device 25. The ECU 11 determines whether or not the adjustment of the lubricant pressure to low by the oil relief device 25 is stopped on the basis of the detection result detected by the water temperature sensor 31 when the engagement of the electromagnetic clutch of the water pump 23 continues for a given period.

6 Claims, 17 Drawing Sheets

NORMAL STATE

ENERGIZED STATE

EXAMPLE OF CHANGING REFERENCE OF LUBRICANT PRESSURE

EXAMPLE OF AN OUTPUT RANGE FOR PERMITTING IMPROVEMENT OF WARM-UP CHARACTERISTICS

EXAMPLE OF COOLANT CIRCULATION STOP CONTROL

EXAMPLE OF REGION OF PREDICTED COOLANT TEMPERATURE CALCULATED

CONTROL DEVICE FOR INTERNAL COMBUSTION ENGINE

TECHNICAL FIELD

The present invention relates to a control apparatus of an internal combustion engine.

BACKGROUND ART

Recently, in order to improve the warm-up characteristics of an internal combustion engine, a water pump is controlled to temporarily stop coolant circulation while the water-cooled internal combustion engine is being warmed up. For example, there is proposed a technology of intermittently flowing a coolant in coolant channels within the internal combustion engine by intermittently driving an electric pump force-feeding the coolant in the time the internal combustion engine is cold. This technology can reduce the heat release of the internal combustion engine while suppressing the increase in temperature in the periphery of the cylinder. Therefore, the warm-up of the internal combustion engine can be promoted (see Patent Document 1).

Also, conventionally, there is broadly known a control for switching between high or low of the lubricant pressure that is pressure fed by a lubricant pump driven in response to the temperature or the driving state of the internal combustion engine. For example, there is proposed a technology which controls the lubricant pressure to low when the internal combustion engine might not overheat in a low load and low speed region. Also, this technology finely estimates the overheat of the internal combustion engine and controls the lubricant pressure to the normal pressure, when the internal combustion engine is in a high load and high speed region. In this technology, while the load of the lubricant pump is reduced by the low lubricant pressure control, the increasing rate of the coolant temperature is reduced by changing the oil pressure to the normal oil pressure when the driving of a cooling fun is expected. Therefore, the operation period of the cooling fun can be reduced to the minimum. Since the load of the internal combustion engine is reduced, high mileage improvement effect can be ensured (see Patent Document 2). In the internal combustion engine performing such a control, the oil pressure within the lubricant path is controlled by closing or opening an electromagnetic valve. Such a system is referred to as two-stage hydraulic system. The two-stage hydraulic system can reduce the load of the lubricating oil pump when the viscosity of the lubricant is high by relieving lubricant in a low oil pressure state, and can stop ejecting the lubricant from a piston oil jet in the cold engine state. This allows reducing the load of the internal combustion engine and the mileage improvement by the improvement of the warm-up characteristics.

Patent Document 1: Japanese Unexamined Patent Application Publication No. 2006-214280

Patent Document 2: Japanese Unexamined Patent Application Publication No. 06-221127

DISCLOSURE OF THE INVENTION

Problems to be Solved by the Invention

By suitably controlling the combination of the coolant stop control and the two-stage hydraulic system, it is expected that the warm-up characteristics of the internal combustion engine are greatly improved. However, the driving region for the coolant stop control and the driving region for the low oil pressure control by the two-stage hydraulic system overlap with each other in most parts. Therefore, in a case where both controls are mixed, the temperature of the internal combustion engine is changed by performing one of the two controls, so that the other control might not be suitably performed. For example, in a case where both of the controls are performed on the basis of the coolant temperature, the coolant temperature is rapidly increased when the circulation of the coolant is stopped. This decreases the region where the low oil pressure control is performed by the two-stage hydraulic system. Because it is difficult for the conventional technologies to cooperatively control both systems in the suitable manner, the warm-up characteristics of the internal combustion engine are not significantly improved.

Thus, the present invention has been made in view of the circumstances and has an object to provide a control apparatus of an internal combustion engine that greatly improves a warm-up characteristics of the internal combustion engine including a cooling medium circulation stop portion and a low oil pressure adjusting portion.

Means for Solving the Problems

In order to solve the above problems, a control apparatus of an internal combustion engine described herein, characterized by includes: a cooling medium circulation stop portion stopping circulation of a cooling medium in a cooling medium flow path; a low oil pressure adjusting portion adjusting an lubricant pressure within a lubricant flow path of the internal combustion engine to lower than a normal oil pressure; a temperature detecting portion detecting a temperature of the internal combustion engine; and a control portion controlling the cooling medium circulation stop portion and the low oil pressure adjusting portion on the basis of a result detected by the temperature detecting portion. The control portion determining whether or not the low oil pressure adjusting portion stops, on the basis of the detection result detected by the temperature detecting portion at the time the cooling medium circulation stop portion continuously stops for a given period.

With such a configuration, the temperature of the internal combustion engine can be detected with high accuracy, thereby suitably adjusting the lubricant pressure on the basis of the temperature of the internal combustion engine adequately. When the cooling medium circulation is stopped by the cooling medium circulation stop portion, the temperature of the cooling medium is rapidly increased within a short period. Therefore, the temperature of a sliding portion and that of the lubricant of the internal combustion engine are not detected with accuracy, so that the temperature higher than the actual one might be detected. Thus, when it is determined whether or not the lubricant oil pressure adjusting portion is performed in response to the temperature of the internal combustion engine detected while the cooling medium circulation stop portion is operating, although the engine is in the driving region where the lubricant oil pressure adjusting portion is operable, the performance might be stopped. Therefore, it is determined whether or not the lubricant oil pressure adjusting portion is stopped on the basis of the temperature of the internal combustion engine at the time the cooling medium circulation has continued for a given period. Therefore, the lubricant oil pressure adjusting portion suitably operates on the basis of the temperature of the internal combustion engine finely detected. Accordingly, the warm-up characteristics of the internal combustion engine can be further improved without harming the region where the lubricant pressure is adjusted to low.

In such a control apparatus of the internal combustion engine, the control portion may permit the cooling medium circulation stop portion and the low oil pressure adjusting portion to stop, only when the output of the internal combustion engine falls within a given region; and the control portion may reduce the region where the cooling medium circulation stop portion and the low oil pressure adjusting portion are permitted to operate, while the cooling medium circulation stop portion and the low oil pressure adjusting portion are simultaneously operating.

Such a configuration can suppress the increase in the temperature of each portion of the internal combustion engine, thereby suppressing the sliding portion from being burned while improving the warm-up characteristics of the internal combustion engine. When the cooling medium circulation stop portion or the lubricant oil pressure adjusting portion operates, the temperature of each portion of the internal combustion engine is increased. Therefore, the cooling medium circulation stop portion or the lubricant oil pressure adjusting portion operates at the time the output of the internal combustion engine is greater than a given output, resulting in that the sliding portion might be burned. Thus, the cooling medium circulation stop portion or the lubricant oil pressure adjusting portion is permitted to operate, only when the output of the internal combustion engine is in a given region, thereby suppressing burning of the sliding portion. Specifically, when the cooling medium circulation stop portion and the lubricant oil pressure adjusting portion simultaneously operate, the cooling ability of the internal combustion engine is greatly reduced and the temperature of each portion promptly increases. Thus, only when the output of the internal combustion engine is in a small region, both controls is permitted to operate, thereby suppressing the burning of the sliding portion. Therefore, the control for improving the warm-up characteristics of the internal combustion engine can be performed more safely.

In such a control apparatus of the internal combustion engine, the control portion may prohibit the operation of the cooling medium circulation stop portion, when the low oil pressure adjusting portion cannot stop operating.

Such a configuration can suppress the temperature of each portion of the internal combustion engine, even when the low oil pressure adjusting portion is in error or has a failure. Therefore, the burning of the sliding portion can be suppressed while improving the warm-up characteristics of the internal combustion engine. When the low oil pressure adjustment cannot be stopped by the system error or failure, the temperature of the each portion is excessively increased by the lack of the cooling ability of the internal combustion engine. Thus, the sliding portion might be burned. For this reason, when the low oil pressure adjusting portion cannot be stopped, the cooling ability of the internal combustion engine is ensured by prohibiting the operation of the cooling medium circulation stop portion, thereby suppressing the excessive increase of the temperature of the each portion. Therefore, the burning of the sliding portion of the internal combustion engine is suppressed, and the warm-up characteristics can be controlled to be improved safely.

In such a control apparatus of the internal combustion engine, the control portion may prohibit the operation of the low oil pressure adjusting portion, when the cooling medium circulation stop portion cannot stop operating.

Such a configuration can suppress the excessive increase of the temperature of each portion of the internal combustion engine, even when the cooling medium circulation stop portion has a system error or a trouble. Thus, the sliding portion can be suppressed from being burned while the warm-up characteristics of the internal combustion engine are improved. When the cooling medium circulation stop process cannot be stopped by the system error or the trouble, the temperature of the each part is excessively increased by lack of the cooling ability of the internal combustion engine. In the result, the sliding portion is burned. Therefore, when the cooling medium circulation stop portion cannot be stopped, the cooling ability of the internal combustion engine is ensured by prohibiting the operation of the low oil pressure adjusting portion, thereby suppressing the excessive increase of the temperature of each portion. This can suppress the burning of the sliding portion of the internal combustion engine, thereby safely improving the warm-up characteristics.

In such a control apparatus of the internal combustion engine, the control portion may prohibit the operation of the low oil pressure adjusting portion, when the detection result detected by is equal to or more than a first threshold.

With such a configuration, when the temperature of the internal combustion engine is higher than a given temperature, the lubricant pressure can be adjusted from low to normal, regardless of the stop of the cooling medium circulation stop portion. Therefore, an excessive increase in the lubricant temperature is suppressed, thereby suppressing the lack of the oil slick in the sliding portion. It is determined whether or not the low oil pressure adjusting portion is stopped after the coolant circulation continues for a given period, thereby operating the low oil pressure adjusting portion on the basis of the temperature of the internal combustion engine detected with high accuracy. However, depending on an air temperature or the output of the internal combustion engine, the increase rate of the cooling medium is greater than that of the lubricant. In that case, when it is determined that the low oil pressure adjusting portion is stopped after the cooling medium circulation continues for a given period, the lubricant temperature might be excessively increased to lack the oil slick in the sliding portion. Therefore, when the temperature of the internal combustion engine is more than a given temperature, the lubricant pressure is adjusted from low to normal, regardless of the cooling medium circulation. This can suppress the excessive increase of the lubricant temperature. Therefore, the sliding portion of the internal combustion engine can be suppressed from being burned, thereby safely improving the warm-up characteristics.

In such a control apparatus of the internal combustion engine, the temperature detecting portion may detect the temperature of the internal combustion engine on the basis of at least one of the rotational number of the internal combustion engine, a load of the internal combustion engine, a temperature of the cooling medium, and a temperature of the lubricant.

With such a configuration, the temperature of the internal combustion engine can be finely detected on the basis of at least one of the rotational number of the internal combustion engine, the load thereof, the cooling medium temperature, and the lubricant temperature. Consequently, the improvement of the warm-up characteristics is achieved with high efficiency on the basis of the temperature of the internal combustion engine detected with high accuracy.

Effects of the Invention

According to the control apparatus of the internal combustion engine according to the present invention, a control for stopping cooling medium circulation and a control for adjusting a lubricant pressure to low are mixed with high efficiency in a cold state of the internal combustion engine. This can greatly improve the warm-up characteristics of the internal combustion engine including the cooling medium circulation stop portion and the low oil pressure adjusting portion.

BEST MODES FOR CARRYING OUT THE INVENTION

Figure 1:
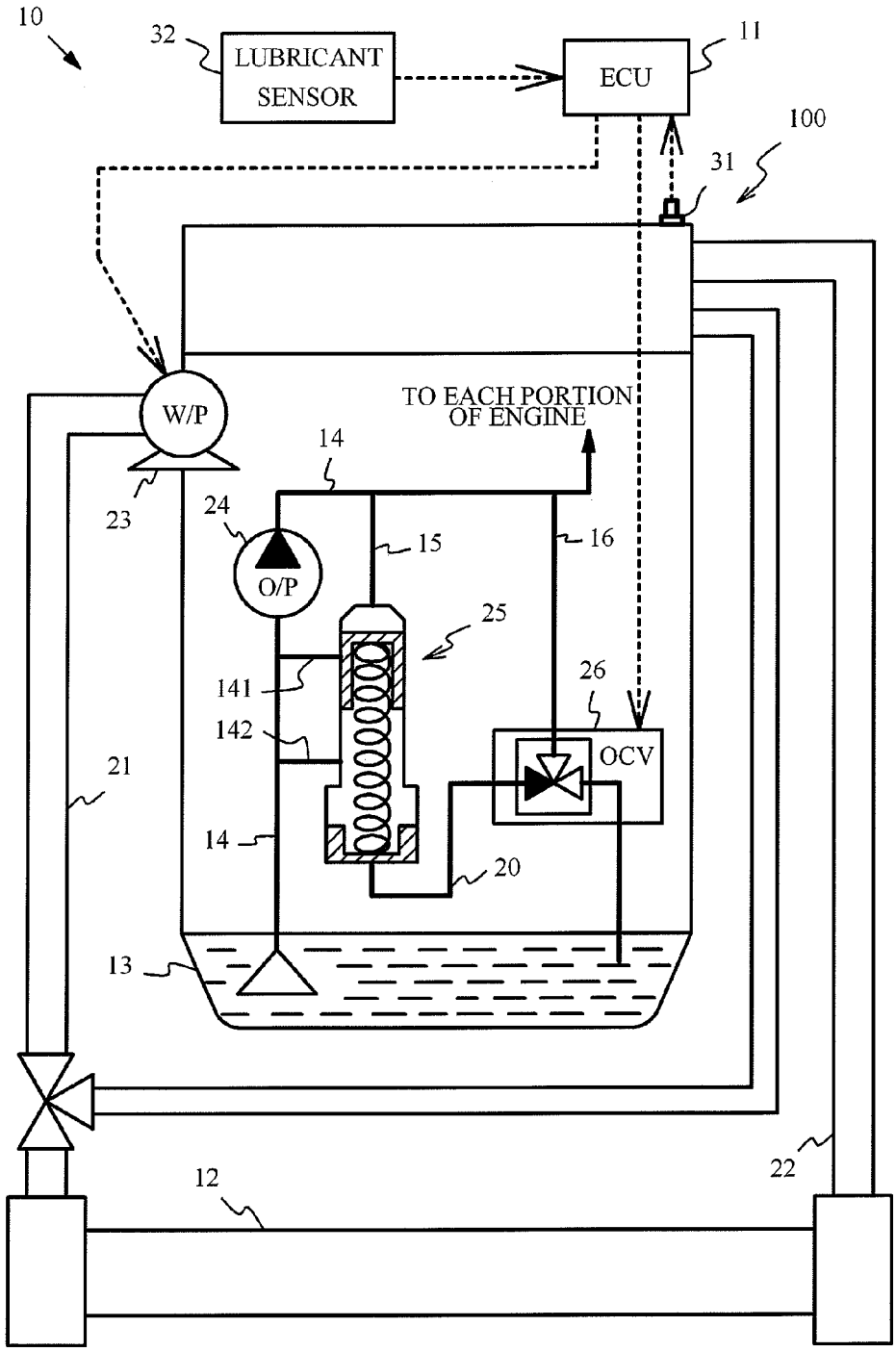
FIG. 1 is a schematic view of a vehicle control system into which a control apparatus of an internal combustion engine according to the present invention is incorporated, and illustrates a relief valve closed and an OCV adjusting a lubricant pressure to low.

An embodiment according to the present invention will be described later in detail with the accompanied drawings.

Embodiment

FIGS. 1 to 4 are schematic views of a vehicle control system 10 including a control apparatus of an internal combustion engine according to the present invention. The vehicle control system 10 includes an engine 100 as a power source. Also, the vehicle control system 10 includes an ECU (Electronic Control Unit) 11 generally controlling the driving operation of the vehicle control system 10. The vehicle control system 10 includes: first and second flow paths 21 and 22 through which the cooling medium circulates between a radiator 12 and the engine 100; a water pump 23 pressure-feeding and circulating the cooling medium. Further, the vehicle control system 10 includes: an oil pump 24 pressure-feeding and circulating the lubricant; an oil relief device 25 adjusting the supply pressure of the lubricant; and a oil control valve (hereinafter, referred to as OCV) 26.

Figure 2:
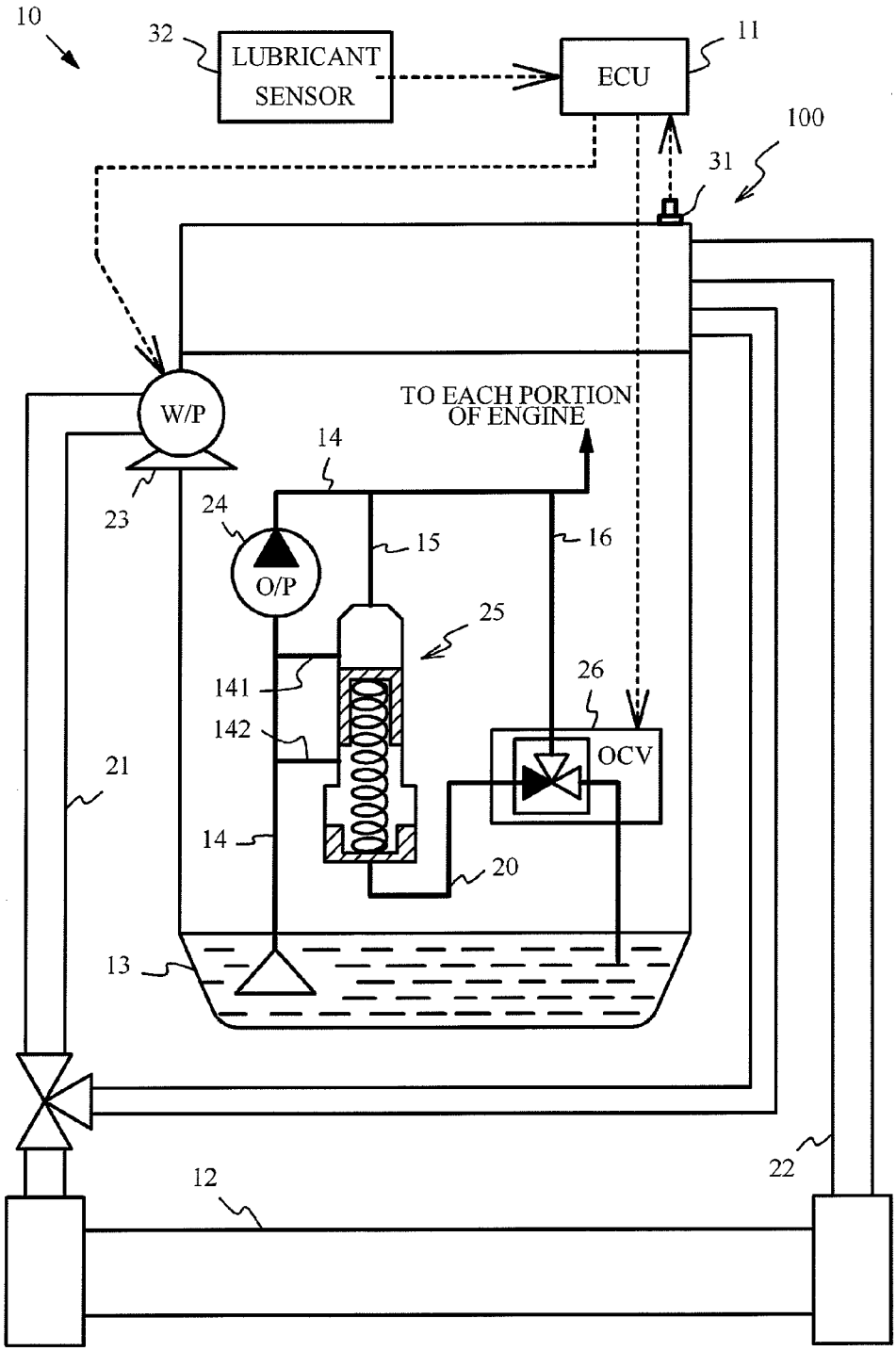
FIG. 2 shows the relief valve opened and the OCV adjusting the lubricant pressure to low.
Figure 3:
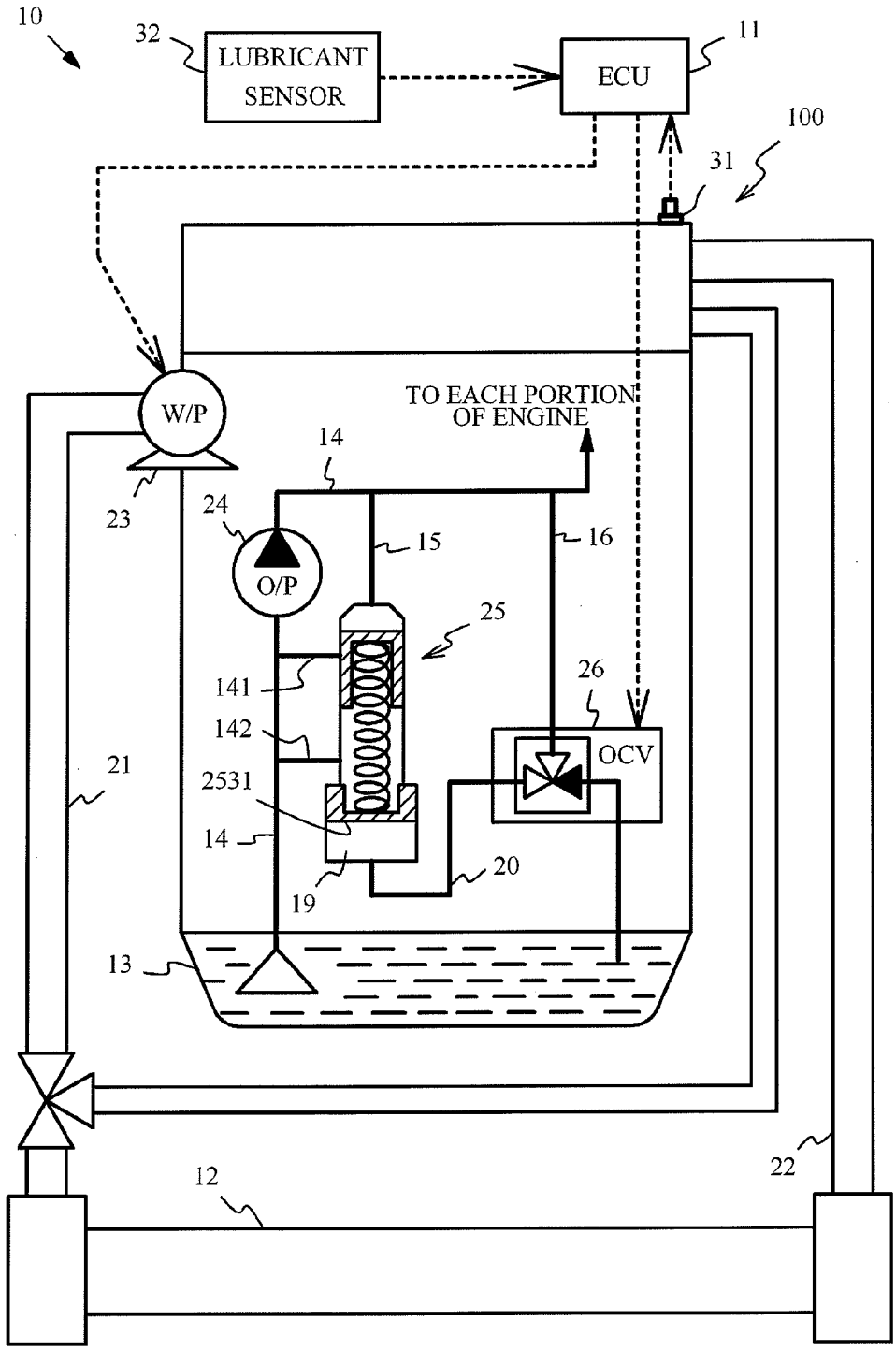
FIG. 3 illustrates the relief valve closed and the OCV adjusting the lubricant pressure to normal.
Figure 4:
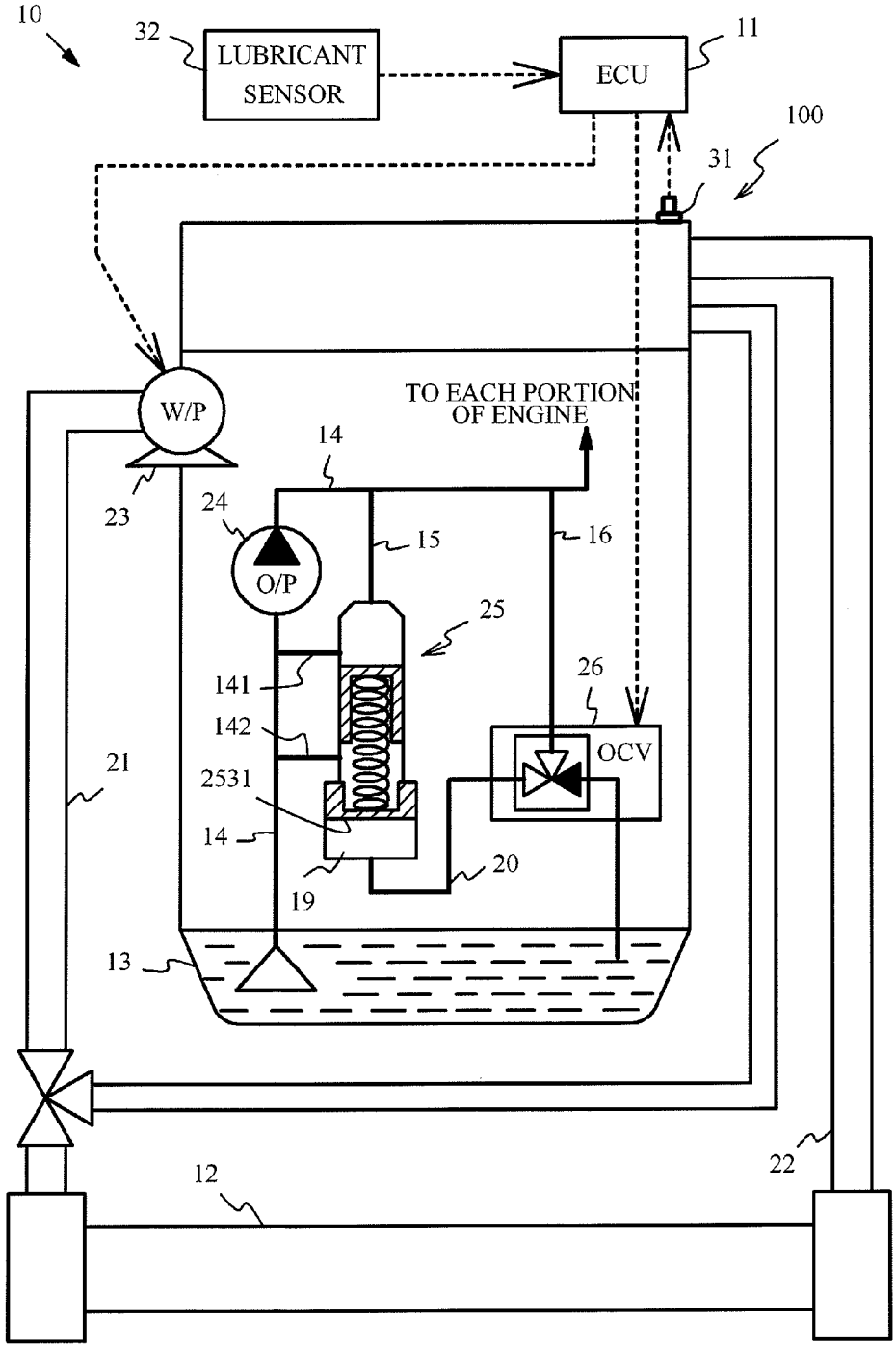
FIG. 4 shows the relief valve opened and the OCV adjusting the lubricant pressure to normal.

FIG. 1 shows a relief valve 252 closed and the OCV 26 adjusting the lubricant pressure to low. FIG. 2 shows the relief valve 252 opened and the OCV 26 adjusting the lubricant pressure to low. FIG. 3 shows the relief valve 252 closed and the OCV 26 adjusting the lubricant pressure to normal. FIG. 4 shows the relief valve 252 opened and the OCV 26 adjusting the lubricant pressure to normal. In this way, the vehicle control system 10 changes the relief pressure of the lubricant between two stages to adjust the lubricant pressure fed to the engine 100.

The engine 100 is a multi cylinder engine mounted on a vehicle. Each of the cylinders includes a piston defining a combustion chamber. The piston arranged within each combustion chamber is coupled through a connecting rod to a crank shaft as an output shaft. The mixed gases flowed from an inlet port into the combustion chamber is compressed in the combustion chamber by the upstroke of the piston. The ECU 11 determines spark timings and sends signals to an igniter, on the basis of the piston position sent from a crank sensor and the camshaft rotational phase sent from an intake cam sensor. The igniter energizes the spark plug in indicated the spark timing in response to a signal sent from the ECU 11. The spark plug is ignited based on the electricity from the battery, and fires the compression mixed gas. Therefore, the gas within the combustion chamber is expanded to move the piston downwardly. This downward movement is changed into the rotation of the crank shaft through the connecting rod, whereby the engine 100 obtains power.

A water jacket is provided around the combustion chamber of the engine 100. The cooling medium (coolant) for cooling the combustion chambers is circulated in the water jacket. The general Long Life Coolant (LLC) made of an ethylene glycol solution is used as the coolant in the present embodiment. However, another cooling medium may be employed. The water jacket is provided with a water temperature sensor 31, which measures the coolant temperature and which sends the detection result of the coolant temperature in the water jacket to the ECU 11. The ECU 11 recognizes the temperature of the engine 100 in response to the coolant temperature detected by the water temperature sensor 31. In this case, the water temperature sensor 31 may be provided in such an arbitrary position to detect a comparatively high temperature of the coolant within the engine 100. For example, the water temperature sensor 31 is provided near the outlet of the coolant (near the connection portion between the engine 100 and the second flow path 22). Additionally, the water temperature sensor 31 corresponds to a temperature detecting portion according to the present invention.

The radiator 12 includes an upper tank, a radiator core, and a lower tank. The radiator 12 is cooled by the air flow which is introduced from the outside of the vehicle or is made by a radiator fan, thereby cooling the circulation coolant. The coolant, which becomes a high temperature by cooling the engine 100, flows through the second flow path 22 to the upper tank of the radiator 12 and the radiator core. The radiator core receives and radiates the heat when the high temperature coolant passes through the radiator core. The radiator core has many fins for the improvement of the heat radiation efficiency. The coolant cooled by the radiator core flows from the lower tank thorough the first flow path 21 to the engine 100 again.

The vehicle control system 10 includes the first and second flow paths 21 and 22 through which the coolant flows. The first flow path 21 causes the engine 100 to communicate with the lower tank of the radiator 12, and circulates the coolant cooled by the radiator 12 to the engine 100. In the first flow path 21, a three-way valve is provided and is communicated with a bypass flow path for the coolant, the bypass flow path being communicated with the upper portion of the water jacket of the engine 100. Also, the three-way valve is provided with a thermostat, which adjusts the flow rate of the coolant by changing a valve divergence in response to the coolant temperature. The second flow path 22 causes the engine 100 to communicate with the upper tank of the radiator 12, and circulates the coolant heated up by the engine 100 to the radiator 12.

The first flow path 21 is provided with the water pump 23, which causes the coolant to circulate between the radiator 12 and the engine 100. The water pump 23 is a mechanical type, which is driven by the rotational force of the crank shaft axis of the engine 100 transmitted through a belt or the like. However, the water pump 23 may employ an electromotive type which is driven by an electric motor, and may employ a combination of both types. The water pump 23 has an electromagnetic clutch in a transmission portion of the rotational force of the crank shaft axis. The engagement rate of the electromagnetic clutch is adjusted in response to a command from the ECU 11, thereby controlling the transmission rate of the rotational force transmitted from the crank shaft axis. Thus, the circulation and the stop of the coolant are controlled by controlling the water pump 23 to drive or stop. In this case, another variable transmission mechanism may be used instead of the electromagnetic clutch to control the drive and the stop of the water pump 23. Additionally, the water pump 23 corresponds to the cooling medium circulation stop portion according to the present invention.

The vehicle control system 10 includes an oil pan 13 storing the lubricant for being supplied to each portion of the engine 100. By the driving force of the oil pump 24, the lubricant stored in the oil pan 13 caused to flow through a lubricant flow path 14 and to be pressure-fed to each portion of the engine 100 through a main gallery. The lubricant flow path 14 diverges to first and second bypass flow paths 15 and 16 in the downstream of the oil pump 24. The oil relief device 25 is installed in the first bypass flow path 15. The oil relief device 25 is connected with a first relief flow path 141 which relieves the lubricant force-fed by the oil pump 24 to the upstream of the oil pump 24. The main gallery is provided with a lubricant temperature sensor 32 which measures the temperature of the lubricant and which sends the detection result of the lubricant temperature to the ECU 11. The ECU 11 recognizes the temperature of the engine 100 based on the lubricant temperature detected by the lubricant temperature sensor 32. In this case, the lubricant temperature sensor 32 is not limited to be provided in the main gallery. The lubricant temperature sensor 32 may be provided in such an arbitrary position, within the engine 100, to detect a comparatively high temperature of the lubricant. Additionally, the lubricant temperature sensor 32 corresponds to the temperature detecting portion according to the present invention.

Figure 5:
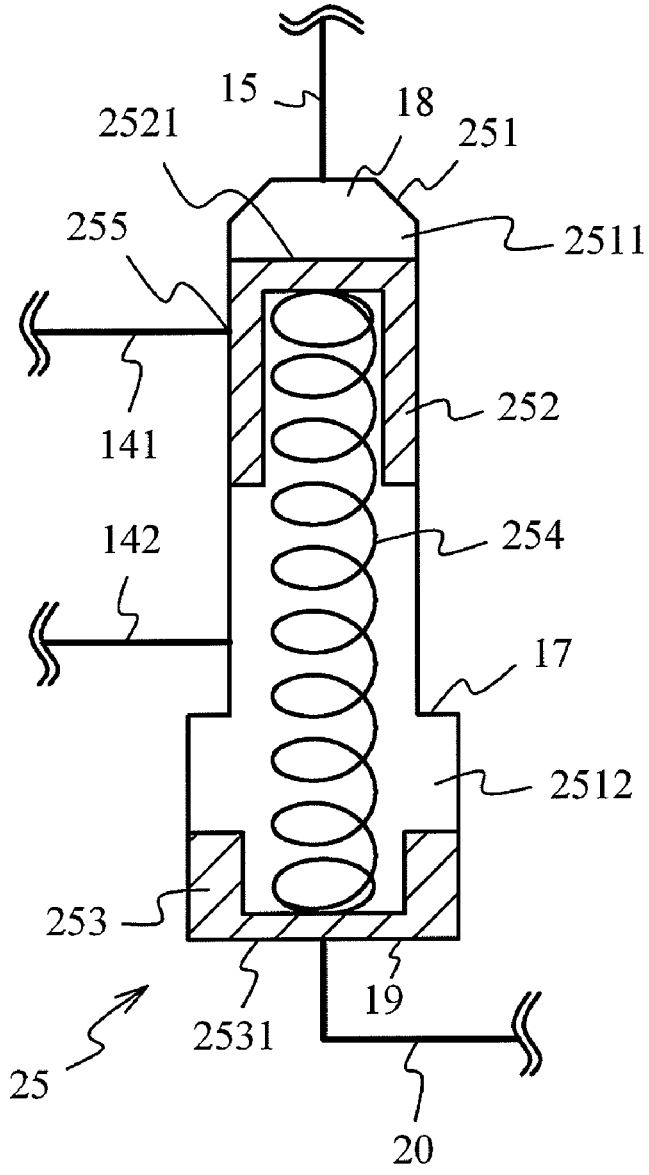
FIG. 5 shows a configuration of an oil relief device.

FIG. 5 shows a configuration of the oil relief device 25. The oil relief device 25 includes: the relief valve 252 and a retainer 253 arranged within a case 251; and a spring (an elastic body) sandwiched therebetween. The case 251 has a small diameter portion 2511 with a small cross-sectional diameter and a large diameter portion 2512 with a large cross-sectional diameter. A step portion, which is provided between the small and large diameter portions 2511 and 2512, corresponds to a stopper 17 restricting the moving distance of the retainer 253 toward the relief valve 252.

The end of the small diameter portion 2511 of the case 251 forms a main chamber 18. The lubricant in the downstream of the oil pump 24 is introduced to the main chamber 18 through the first bypass flow path 15. The main chamber 18 is provided with a first relief opening 255 to which the first relief flow path 141 is communicated. The relief valve 252 is provided within the main chamber 18. The relief valve 252 receives the oil pressure in the main chamber 18 at a pressure receiving surface 2521. The case 251 is communicated with a second relief flow path 142, which discharges the lubricant flowing between the relief valve 252 and the retainer 253 to the upstream of the oil pump 24.

The end of the large diameter 2512 of the case 251 forms a sub chamber 19 into which the lubricant of the downstream of the oil pump 24 is introduced through the OCV 26. The retainer 253 is provided within the sub chamber 19. The area of a pressure receiving surface 2531, receiving the oil pressure in the sub chamber 19, of the retainer 253 is greater than that of the pressure receiving surface 2521 of the relief valve 252. For this reason, the OCV 26 is changed to a usual oil pressure state, and the same oil pressure acts on the pressure receiving surface 2531 of the retainer 253 and the pressure receiving surface 2521 of the relief valve 252, whereby the retainer 253 is exerted by the force greater than that of the relief valve 252. In such a state, the retainer 253 compresses a spring 254. This increases the relief pressure of the relief valve 252. When the retainer 253 abuts with the stopper 17, the spring 254 is not further compressed.

In this way, the oil relief device 25 changes the position of the retainer 253 to adjust the biasing force of the spring 254. The opening pressure of the relief valve 252 can be changed in response to a change of this biasing force. Such a change of the position of the retainer 253 can be performed by the OCV 26, which operates according to a command from the ECU 11. In a case of using the OCV 26, the relief valve 252 can be located near the oil pump 24. This can reduce a workload of the oil pump 24. Also, the electric control is enabled, whereby the control characteristic is better than that in a case where the oil pressure is mechanically controlled.

Further, the portion for changing the position of the retainer 253 is not limited to the OCV 26, and may employ another configuration. For example, a rod may be pushed by thermo wax, and the retainer 253 may be moved by this rod. In this case, the combination of thermo wax and the heater may be used, and the rod can be moved by the electrical control of the heater. Further, a cam may be employed for pushing the retainer 253 toward the relief valve 252. In this case, the relief pressure of the lubricant can be changed by controlling the cam position. Additionally, the oil relief device 25 corresponds to a low oil pressure adjusting portion according to the present invention.

The OCV 26 is a three-way valve which introduces the lubricant force-fed from the oil pump 24 through the second bypass flow path 16 to the sub chamber 19 of the oil relief device 25 or the oil pan 13. FIG. 6 shows a configuration for the OCV 26. The OCV 26 includes: a case 261 defining a first chamber 2611, a communication portion 2612, and a second chamber 2613; and a needle 262 within the case 261. The needle 262 is provided at its end with a ball valve 2621 and at its other end with a drive portion 2622 which slides according to the energization of a coil portion 263. In the needle 262, the ball valve 2621 is arranged within the first chamber 2611 and the driving portion 2622 is arranged within the second chamber 2613. A first spring (elastic body) 264 which abuts the ball valve 2621 is arranged within the first chamber 2611. A second spring (elastic body) 265 which abuts the driving portion 2622 is arranged within the second chamber 2613. The boundary between the first chamber 2611 and the communication portion 2612 defines a first seal portion 266 where the ball valve 2621 is seated. The boundary between the communication portion 2612 and the second chamber 2613 defines a second seal portion 267 where the driving portion 2622 is seated. The communication portion 2612 is formed with a first aperture 268. The second chamber 2613 is formed with a second aperture 269 which introduces oil into the oil pan 13.

Figure 6A:
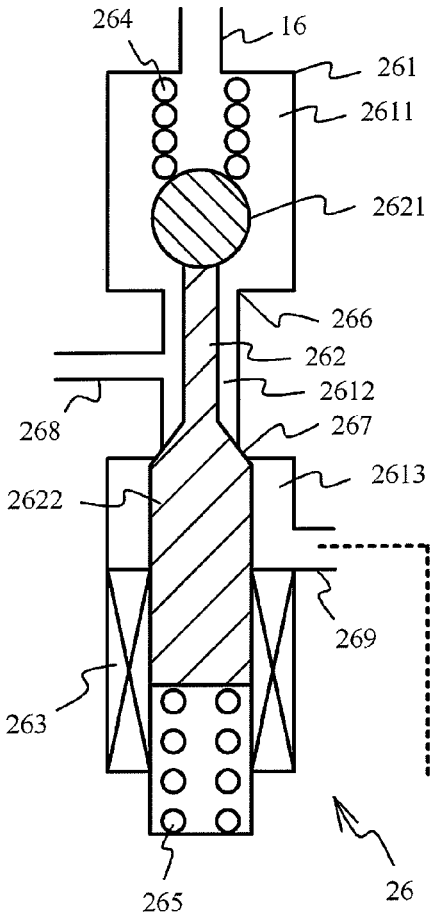
FIG. 6 shows a configuration of the OCV 26.
Figure 6B:
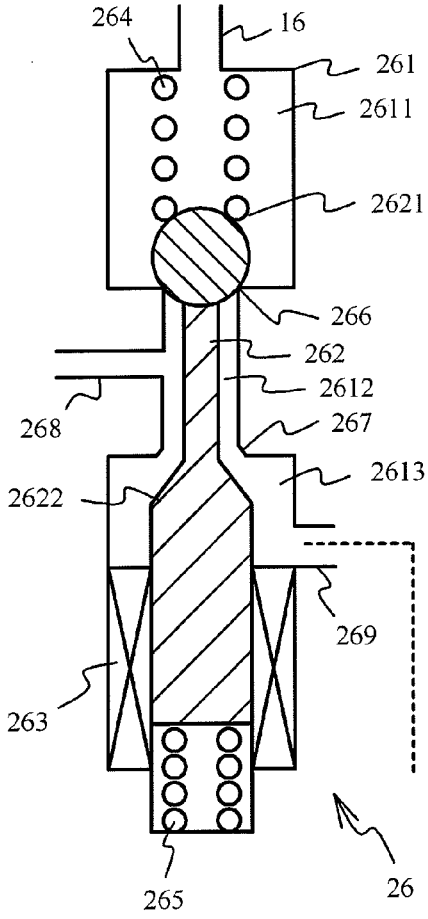

The coil portion 263 is electrically connected to the ECU 11. The second bypass flow path 16 is connected to the first chamber 611 into which the lubricant pressure-fed from the oil pump 24 flows. FIG. 6A shows a state (normal) where the coil portion 263 is not energized. In this state, the needle 262 biased by the second spring 265 is pushed upwardly, and the driving portion 2622 is seated in the second seal portion 267. Since the first seal portion 266 is opened, the lubricant flows into the communication portion 2612 and discharges from the first aperture 268. On the other hand, FIG. 6B shows the coil portion 263 energized. In this state, the drive portion 2622 is moved downwardly against the biasing force of the second spring 265. In this time, the ball valve 2621 is seated on the first sealing member 266. For this reason, the lubricant force-fed from the second bypass flow path 16 is not discharged from either the first aperture 268 or the second aperture 269.

One end of a communication pipe 20 is connected to the first aperture 268 of the OCV 26. The other end of this communication pipe 20 is connected to the sub chamber 19. That is, the OCV 26 and the sub chamber 19 are communicated to each other through the communication pipe 20. This communication pipe 20 is located in the downstream of the OCV 26, and defines the lubricant flow path communicating the sub chamber 19 and the OCV 26. The lubricant force-fed to the OCV 26 has a pressure identical to that of the oil within the main gallery. Thus, as shown in FIGS. 3 and 4, each oil pressure within the OCV 26, the communication pipe 20, and the sub chamber 19 is identical to the oil pressure within the main gallery, when the lubricant force-fed from the oil pump 24 is introduced into the sub chamber 19. On the other hand, as shown in FIGS. 1 and 2, each oil pressure within the OCV 26, the communication pipe 20, and the sub chamber 19 is maintained at low, in the case where the lubricant force-fed from the oil pump 24 is introduced into the oil pan 13. In this way, the lubricant pressure state within the communication pipe 20 is changed between low and normal by the operation of the OCV 26. Additionally, the OCV 26 corresponds to a low lubricant pressure adjusting portion according to the present invention.

The ECU 11 is a computer including: a Central Processing Unit (CPU) performing calculation; a Read Only Memory (ROM) storing programs; a Random Access Memory (RAM) or a Non Volatile RAM (NVRAM) storing data. The ECU 11 reads the detection results of the crank angle sensor, the intake cam corner sensor, an air flow mater, a throttle position sensor, an exhaust gas temperature sensor, the water temperature sensor 31, and the lubricant temperature sensor 32. The ECU 11 comprehensively controls the driving operation of the engine 100 such as the operation of the throttle valve, the opening and shutting timings of intake and exhaust valves, the operation of the injector, and the ignition timing of the spark plug.

Further, the ECU 11 adjusts the lubricant pressure to low, while stopping the coolant circulation when the engine 100 is cold. This controls the warm-up characteristics of the engine 100 to be improved. The warm-up characteristics of the engine 100 will be described below.

Figure 7:
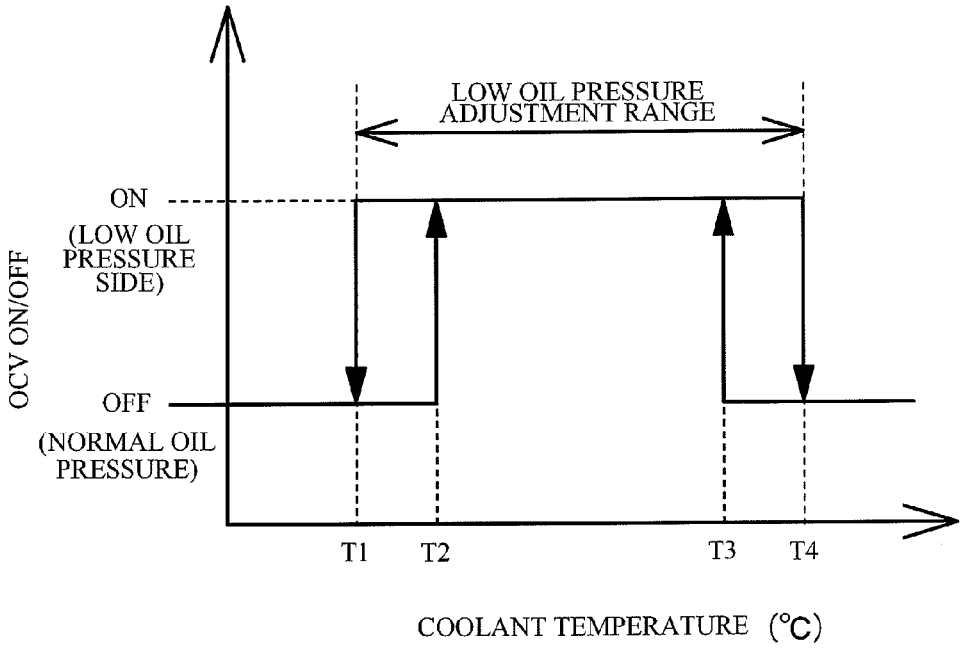
FIG. 7 shows an example of references for changing the lubricant pressure.

The ECU 11 determines whether or not the lubricant pressure is adjusted to low by the two-stage hydraulic system on the basis of the temperature and the output of the engine 100. The ECU 11 detects the temperature of the engine 100 on the basis of at least one of the coolant temperature detected by the water temperature sensor 31, the lubricant temperature detected by the lubricant temperature sensor 32, the engine rotational number detected by the crank angle sensor, and the engine load calculated based on the fuel injection quantity or the intake air quantity. FIG. 7 shows an example of the reference for the change of the lubricant pressure. The reference for the change of the lubricant pressure is defined by a coolant temperature Thw as a map. The reference for the change of the lubricant defines four values. The four values are, T1 [degrees Celsius] where the oil pressure is changed from low to normal when the coolant temperature decreases in light of a hysteresis, T2 [degrees Celsius] where the oil pressure is changed from normal to low when the coolant temperature increases, T3 [degrees Celsius] where the oil pressure is changed from normal to low when the coolant temperature decreases, and T4 [degrees Celsius] where the oil pressure is changed from low to the normal when the coolant temperature increases. The ROM of the ECU 11 beforehand stores these references T1 to T4 as a map. When the detection result of the temperature of the engine 100 is in a range from T1 (for example, 0 [degrees Celsius]) to T4 (for example, 87 [degrees Celsius]), the ECU 11 determines that the condition that the lubricant pressure is adjusted to be low is satisfied.

Figure 8:
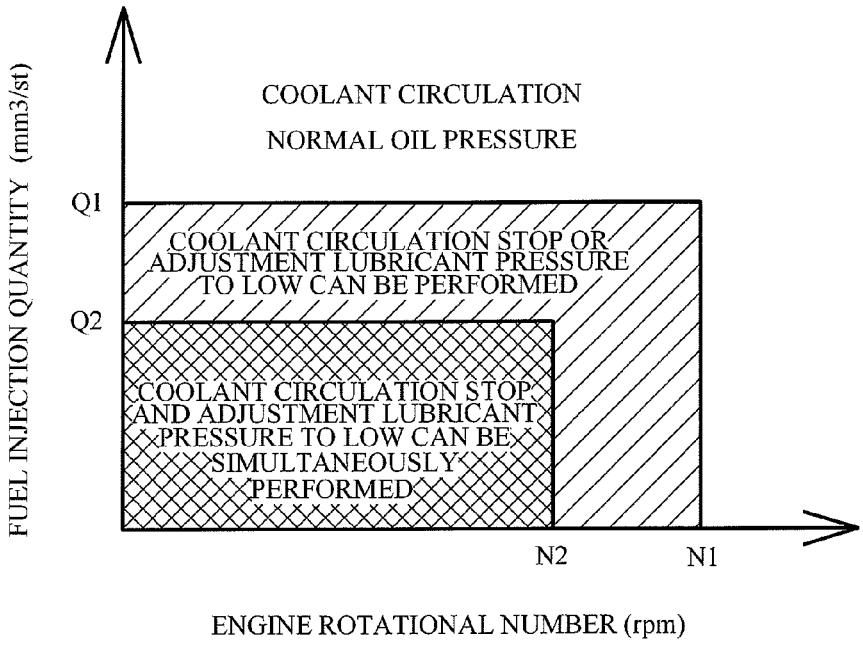
FIG. 8 shows an example of an output range where the control for improving the warm-up characteristics is permitted.

The ECU 11 determines the output of the engine 100 based on the engine rotational number detected by the crank angle sensor and the engine load detected by the fuel injection quantity and the intake air quantity. FIG. 8 shows an example of an output range where the control for improving the warm-up characteristics is permitted. The ECU 11 determines that the condition that the lubricant pressure is adjusted to be low is satisfied, only when the output of the engine 100 falls within a given rotational speed N1 (for example 2600 rpm) and a fuel injection quantity Q1 (for example, 40 mm3/st). When the lubricant pressure is adjusted to be low, the temperature of each portion of the engine 100 increases. Thus, if it is controlled at the time the output of the engine 100 is greater than a given, the sliding portion might be burned. Therefore, the lubricant pressure is permitted to be adjusted to be low, only when the output of the engine 100 is in the low output region. This can suppress the sliding portion from being burned. Therefore, the warm-up characteristics of the engine 100 can be controlled to improve more safely.

When the temperature and output conditions for adjusting the lubricant pressure to low are satisfied, the ECU 11 permits the lubricant pressure to be adjusted to be low. The ECU 11 instructs the OCV 26 to adjust the lubricant pressure to low. This control can reduce the cooling ability of the engine 100 or can reduce the load applied to the oil pump 24. Therefore, the load of the engine 100 in the cold state can be reduced, and the mileage can be improved by the improvement of the warm-up characteristics of the engine 100. When the temperature and output conditions for adjusting the lubricant pressure to low are not satisfied, the ECU 11 stops controlling to adjust the lubricant pressure, and instructs the OCV 26 to adjust the lubricant pressure to normal.

Figure 9:
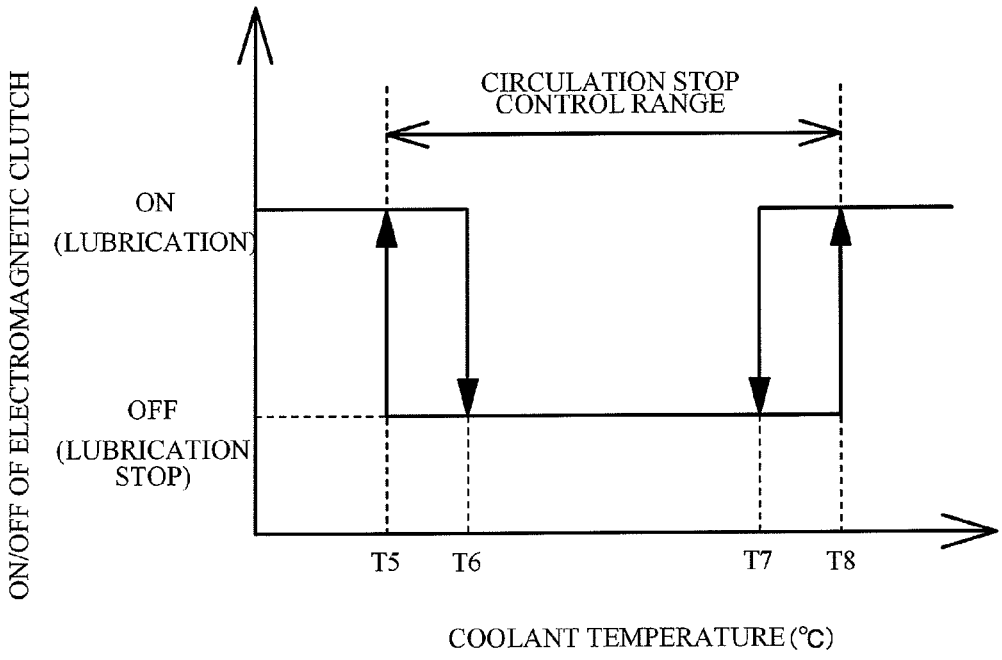
FIG. 9 shows an example of a coolant circulation stop control.

The ECU 11 determines whether or not the coolant circulation is stopped on the basis of the temperature and the output of the engine 100. As mentioned above, the ECU 11 detects the temperature of the engine 100 based on at least one of the coolant temperature, the lubricant temperature, the engine speed, and the engine load. FIG. 9 shows an example of the coolant circulation stop control. The reference for the permission of the coolant circulation is defined by a coolant temperature Thw as a map. The reference for the permission of the coolant circulation defines four values. The four values are, T5 [degrees Celsius] where the stop circulation is changed to the start circulation when the coolant temperature decreases in light of a hysteresis, T6 [degrees Celsius] where the start circulation is changed to the stop circulation when the coolant temperature increases, T7 [[degrees Celsius] where the start circulation is changed to the stop circulation when the coolant temperature decreases, and T8 [degrees Celsius] where the stop circulation is changed to the start circulation when the coolant temperature increases. The ROM of the ECU 11 beforehand stores these references T5 to T8 as a map. When the detection result of the temperature of the engine 100 ranges from T5 (for example, 0 [degrees Celsius]) to T8 (for example, 80 [degrees Celsius]), the ECU 11 determines that the condition of stopping the coolant circulation is satisfied.

The ECU 11 determines the output of the engine 100 based on the engine rotational number detected by the crank angle sensor and the engine load detected by the fuel injection quantity and the intake air quantity. The ECU 11 determines that the condition for stopping the coolant circulation is satisfied, only when the output of the engine 100 falls within a given rotational speed N1 (for example 2600 rpm) and a fuel injection quantity Q1 (for example, 40 mm3/st) (see FIG. 8). When the coolant circulation is stopped, the temperature of each portion of the engine 100 increases. Thus, it is controlled when the output of the engine 100 is greater than a given output, the sliding portion might be burned. Therefore, the stop of the coolant circulation is permitted, only when the output of the engine 100 falls within the low output region. This suppresses the sliding portion from being burned. Therefore, the control for improving the warm-up characteristics of the engine 100 can be controlled to improve more safely.

When the temperature and output conditions that the coolant circulation is stopped are satisfied, the ECU 11 permits the coolant circulation to stop. The ECU 11 instructs the electromagnetic clutch of the water pump 23 to be disengaged and stops the coolant circulation. This control can reduce the head radiation of the engine 100 when the engine 100 is cold. Therefore, the warm-up characteristics of the engine 100 can be improved. When the temperature and output conditions for stopping the coolant circulation are not satisfied, the ECU 11 stops the coolant circulation stop process, and instructs the electromagnetic clutch of the water pump 23 to be engaged to circulate the coolant.

When the coolant circulation stops and the lubricant pressure is adjusted to low simultaneously, the ECU 11 controls the output condition by which both controls are permitted to be reduced (see FIG. 8). When the coolant circulation stops and the lubricant pressure is adjusted to low simultaneously, the cooling ability of the engine 100 greatly decreases and the temperature of each portion rapidly increases. Therefore, both controls are permitted, only when the output of the engine 100 falls within the more lower output region. This suppresses the sliding portion from being burned. Therefore, the improvement of the warm-up characteristics of the engine 100 can be performed more safely. The ECU 11 reduces the engine speed from N1 to N2 and reduces the fuel injection quantity from Q1 to Q2, the engine speed and the fuel injection quantity being references for permitting the coolant circulation to stop and the lubricant pressure to be adjusted to low so as to be performed simultaneously. N2 applies to an arbitrary engine rotational number sufficiently smaller than N1 where burning is not caused at the time both controls are performed. Q2 applies to an arbitrary fuel injection quantity sufficiently smaller than Q1 where burning is not caused at the time both controls are performed. In this case, the ECU 11 may reduce any one of the permission regions of the engine rotational number and the fuel injection quantity (load).

Further, the ECU 11 prohibits stopping of the coolant circulation, when the adjustment of the lubricant pressure to low cannot be stopped. Likewise, the ECU 11 prohibits the adjustment of the lubricant pressure to low, when the stop process of the coolant circulation cannot be stopped. When the stop process of the coolant circulation or the adjustment of the lubricant pressure to low cannot be stopped by a system error, the temperature of each portion is rapidly increased by the lack of the cooling ability of the engine 100 and the sliding portion might burn. Therefore, when the stop process of the coolant circulation or the adjustment of the lubricant pressure to low cannot be stopped, one of both controls is prohibited, so as to ensure the cooling ability of the engine 100 and suppress the rapid increase in the temperature of each portion. This suppresses the sliding portion from being burned, and the warm-up characteristics of the engine 100 can be improved more safely.

Also, the ECU 11 determines whether or not the lubricant pressure is adjusted to low, on the basis of the temperature of the engine 100 at the time the coolant circulation continues for a given period. When the coolant circulation stops, the coolant temperature is rapidly increased within a short period. Therefore, the temperatures of the sliding portion and the lubricant of the engine 100 can be detected with accuracy, and the temperature higher than the actual one might be detected. Thus, when it is determined whether or not the lubricant pressure adjusted to low is operated in response to the temperature of the engine 100 detected while the coolant circulation stops, although the engine falls within the driving region where the lubricant pressure is adjusted to low, the operation might be stopped. Therefore, it is determined whether or not the lubricant pressure adjusted to low is stopped on the basis of the temperature of the engine 100 at the time the coolant circulation continues for a given period. Thus, the lubricant pressure can be suitably controlled on the basis of the temperature of the engine 100 finely detected. Accordingly, the warm-up characteristics of the engine 100 can be further improved without harming the region where the lubricant pressure is adjusted to low. Here, any given period is applicable to an arbitrary circulation period for the fine detection of the temperature of the engine 100 on the basis of the coolant temperature. For example, the given period can be 20 [sec].

In this case, the ECU 11 adjusts the lubricant pressure to low, regardless of the coolant circulation, when the detection result of the temperature of the engine 100 is greater than a first threshold. The increased rate of the coolant temperature may become higher than that of the lubricant temperature, depending on an air temperature or the output of the engine 100. In that case, after the coolant circulation continues for a given period, it is determined that the low oil pressure adjusting portion stops, so that the lubricant temperature might be rapidly increased to lack the oil slick in the sliding portion. Therefore, when the temperature of the engine 100 is higher than a given temperature, the lubricant pressure is changed from the low pressure to the normal pressure, regardless of the coolant circulation. This can suppress the excessive increase of the lubricant temperature. In such a way, the burning of the sliding portion of the internal combustion engine is suppressed, and the warm-up characteristics can be improved safely. Here, the first threshold is applicable to an arbitrary engine temperature where the sliding portion might be burned by excessively increasing the lubricant temperature. For example, the first threshold is 80 [degrees Celsius]. Additionally, the ECU 11 corresponds to the control portion according to the present invention.

Figure 10:
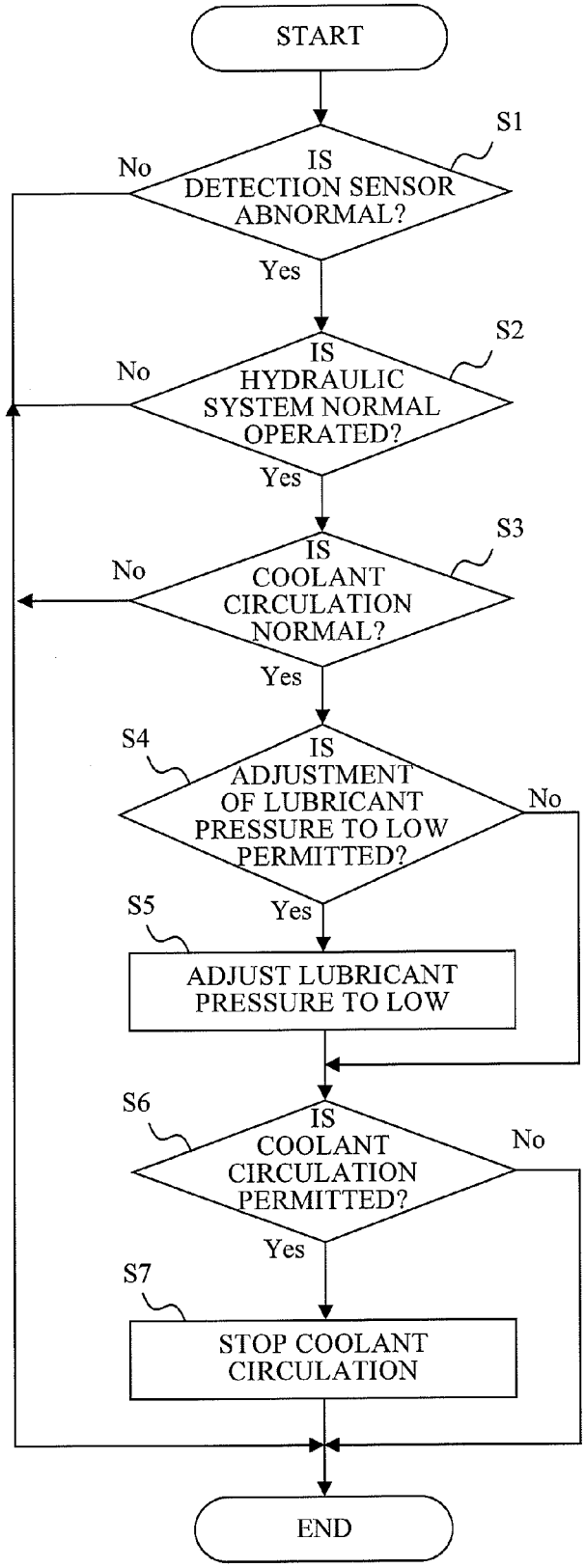
FIG. 10 is a flow chart showing an example of the operation of an ECU.

Next, the operation of the vehicle control system 10 will be described along the operation of the ECU 11. FIG. 10 is a flow chart of an example of the operation of the ECU 11. The Vehicle control system 10 according to the present embodiment includes: the cooling medium circulation stop portion; the low oil pressure adjusting portion; the temperature detecting portion, and the control portion. The control portion determines whether or not the low oil pressure adjusting portion is stopped, on the basis of the results detected by the temperature detecting portion at the time the stop of the cooling medium circulation stop portion continues for a given period. This can greatly improve the warm-up characteristics of the internal combustion engine including the cooling medium circulation stop portion and the low oil pressure adjusting portion.

The ECU 11 starts the operation, when the engine start up is requested, that is, when an ignition switch is turned on. The operation is performed for every given period while the ignition switch is switched on. First, the ECU 11 determines whether or not the sensors for detecting the temperature of the engine 100 (the water temperature sensor 31, the lubricant temperature sensor 32, and the like) are normal in step S1. Since the flow of the determination whether or not the sensors are normal will be described later, and its detailed description is omitted. When the sensor is not usual, that is, unusual (step S1/NO), the ECU 11 prohibits the stop of the coolant circulation and the adjustment of the lubricant pressure to low, and finish this process. When the sensor is usual, that is, not unusual (step S1/YES), the ECU 11 proceeds to next step S2.

In step S2, the ECU 11 performs the initial operation check of the oil relief device 25 and the OCV 26 (two-stage hydraulic system) to determine whether or not the two-stage hydraulic system operates normally. When the two-stage hydraulic system do not operate normally, that is, the system has abnormality (step S2/NO), the ECU 11 prohibits the stop of the coolant circulation and also prohibits the adjustment of the lubricant pressure to low, and finish this process. For example, when the oil relief device 25 adheres to the low oil pressure side, the two-stage hydraulic system do not operate normally. In this case, the cooling ability of the engine 100 decreases. Therefore, when the coolant circulation is stopped, the temperature of each part increases excessively to burn the sliding portion. Thus, when it is determined that the two-stage hydraulic system is abnormal, both of the adjustment of the lubricant pressure to low and the stop of coolant circulation are prohibited. This ensures the cooling ability of the engine 100 and suppresses the sliding portion from being burned. When the two-stage hydraulic system operate normally, that is, the system is not abnormal (step S2/YES), the ECU 11 proceeds to next step S3.

The ECU 11 determines whether or not the coolant circulates normally in step S3. Since the flow of the determination whether or not the coolant circulates normally will be described later, its detailed description is omitted. When the coolant does not circulate normally, that is, it is abnormal (step S3/NO), the ECU 11 prohibits the stop of the coolant circulation and the adjustment of the lubricant pressure to low, and finishes the process. For example, when a coolant does not circulate normally due to the abnormality of the clutch of the water pump 23 or the lack of the coolant, the cooling ability of engine 100 decreases. Therefore, when the lubricant pressure is adjusted to the low pressure, the temperature of each part increases excessively to burn the sliding portion. Thus, when it is determined that the coolant circulation is abnormality, both of the stop of the coolant circulation and the adjustment of the lubricant pressure to low are prohibited, thereby ensuring the cooling ability of the engine and preventing the sliding portion from being burned. When the coolant circulates normally, that is, when there is no abnormality (step S3/YES), the ECU 11 proceeds to next step S4.

In step S4, on the basis of the temperature and the output of the engine 100, the ECU 11 determines whether or not the adjustment of the lubricant pressure to low should be permitted by the two-stage hydraulic system. Since the method of the determination whether or not the lubricant pressure should be adjusted to low has been described above, and its detailed description is omitted. When it is determined that the lubricant pressure adjusted to the low pressure is not permitted (step S4/NO), the ECU 11 proceeds to step S6. When it is determined that the lubricant pressure adjusted to the low pressure is permitted (step S4/YES), the ECU 11 proceeds to next step S5.

In step S5, the ECU 11 orders the OCV 26 to adjust the lubricant pressure to the low pressure. When the ECU 11 finishes the process of step S5, the ECU 11 continues to next step S6.

In step S6, the ECU 11 determines whether or not the stop of the coolant circulation should be permitted, on the basis of the temperature and the output of the engine 100. Since the method of the determination whether or not it is permitted to stop the coolant circulation has been described above, its detailed description is omitted. When it is determined that the stop of the coolant circulation is not permitted (step S6/NO), the ECU 11 advances to step S8. When it is determined that the stop of the coolant circulation is permitted (step S6/YES), the ECU 11 advances to next step S7.

In step S7, the ECU 11 instructs the electromagnetic clutch of the water pump 23 to be disengaged, then stop the coolant circulation. When the ECU 11 finishes the process of step S7, the ECU 11 finishes the operation.

Figure 11:
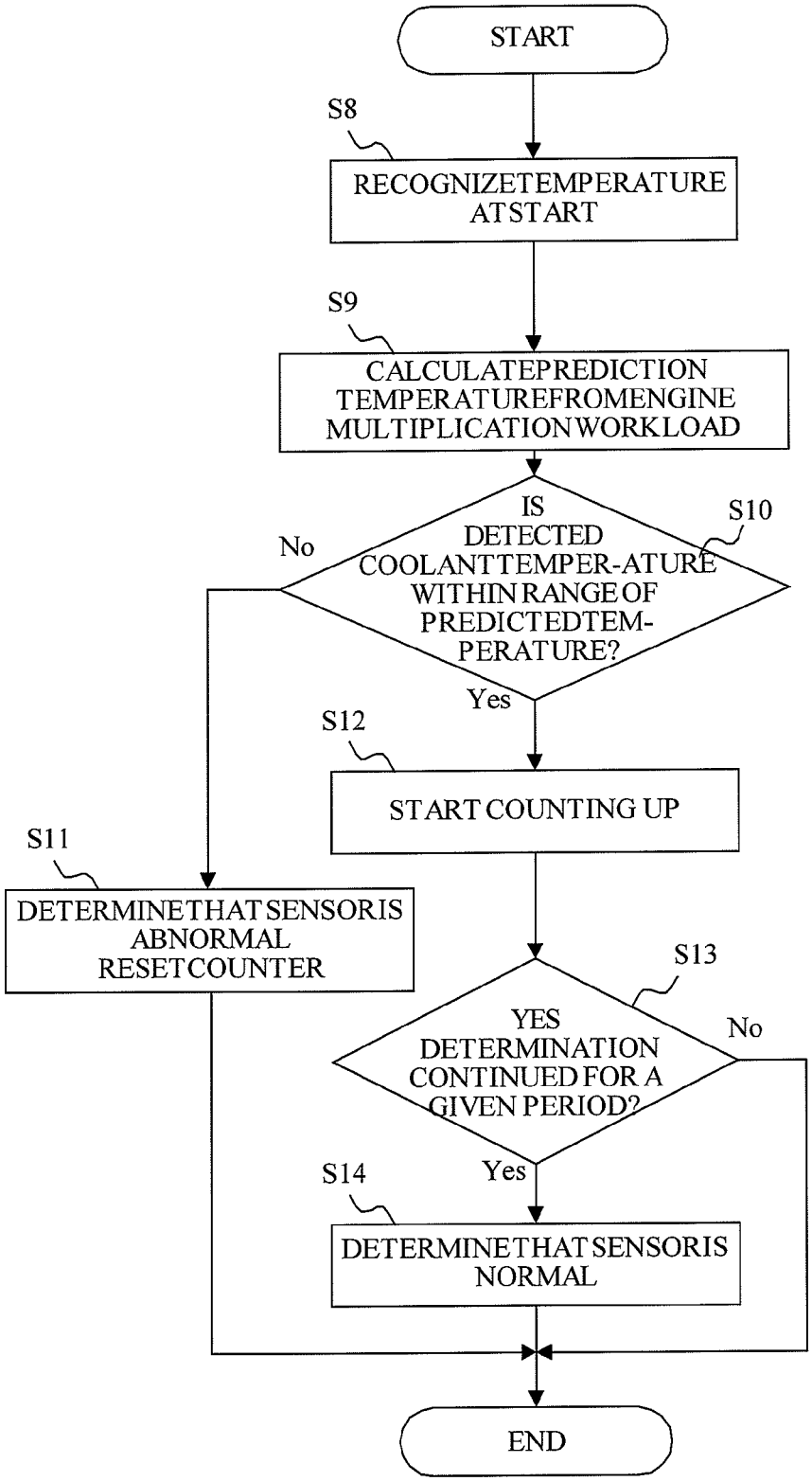
FIG. 11 is a flow chart showing an example of the operation of the ECU.

Next, a flow, performed in step S1, of a determination whether of the failure of the sensor is described below. FIG. 11 is a flow chart showing an example of the operation of the ECU 11. The ECU 11 starts the operation, when the engine start up is requested, that is, when an ignition switch is turned on. The operation is performed every given period while the ignition switch is switched on. The ECU 11 first recognizes the coolant temperature, the intake air temperature, and the outside temperature at the timing of stating up the engine 100 in step S8. The process can improve the accuracy of the prediction of the coolant temperature as will be mentioned later. In this case, another temperature such as the lubricant temperature may be recognized in addition to the coolant temperature. When the ECU 11 finishes the In step S9, the ECU 11 multiplies the rotational number and the load of the engine 100 to calculate the amount of the work. The ECU 11 calculates a predicted temperature of the coolant of the engine 100 on the basis of the calculated work amount. In this case, the ECU 11 can calculate the predicted temperature of the coolant based on the fuel consumption determined by the fuel injection quantity. Also, the ECU 11 can calculate another temperature of such as that of the lubricant in addition to the coolant. When the ECU 11 finishes the process of step S9, the ECU 11 proceeds to next step S10.

Figure 12:
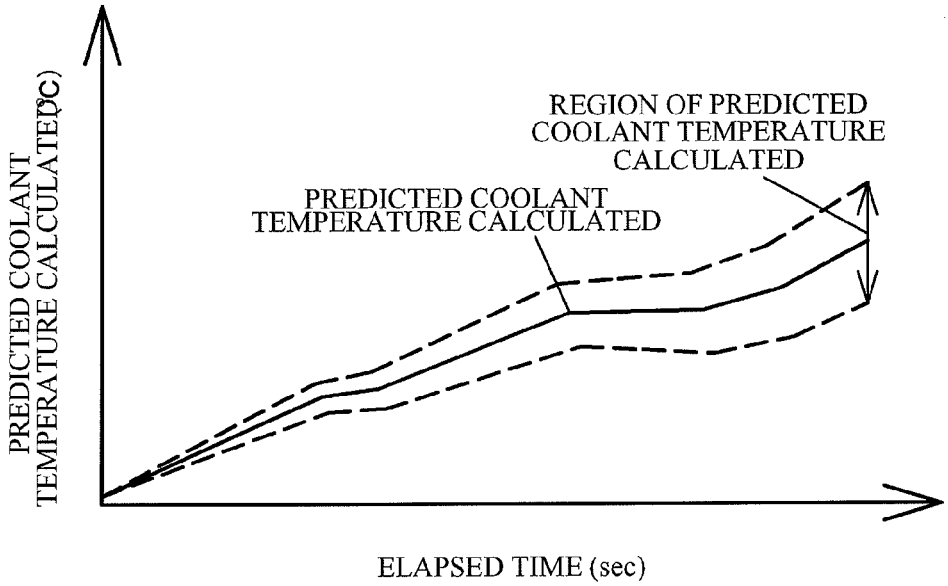
FIG. 12 shows an example of the region of the predicted water temperature that has been calculated.

In step S10, the ECU 11 determines whether or not the detection result of the water temperature sensor 31 falls within the region of the predicted temperature of the coolant calculated in step S9 (See FIG. 12). In this case, in addition to the detection result of the water temperature sensor 31, it can be determined whether or not a detection result of another sensor such as the lubricant temperature sensor falls within the region of the predicted temperature. When the detection result of the water temperature sensor 31 falls within the region of the predicted temperature (step S10/YES), the ECU 11 proceeds to step S12. When the detection result of the water temperature sensor 31 does not fall within the region of the predicted temperature (step S10/NO), the ECU 11 proceeds to next step S11.

In step S11, the ECU 11 determines whether or not the water temperature sensor 31 is not normal, that is, abnormal, to reset a counter. When the ECU 11 finishes the process of step S11, the ECU 11 finishes the operation.

When YES is determined in step S10, the ECU 11 proceeds to step S12. In step S12, the ECU 11 starts counting up. When The ECU 11 finishes the process of step S12, the ECU 11 proceeds to next step S13.

In step S13, the ECU 11 determines whether or not YES determination in step S10 continues for a given period. That control is operated, thereby suppressing the stop of the improvement of the warm-up characteristics caused by temporary increasing the coolant temperature. Here, the given period can be applicable to an arbitrary period for detecting the coolant temperature with accuracy. When YES determination does not continue during the given period (step S13/NO), the ECU 11 finishes the operation. When YES determination continues during the given period (step S13/YES), the ECU 11 advances to next step S14.

In step S14, the ECU 11 determines whether or not the water temperature sensor 31 is normal. When the ECU 11 finishes the process of step S14, the ECU 11 finishes the operation.

Figure 13:
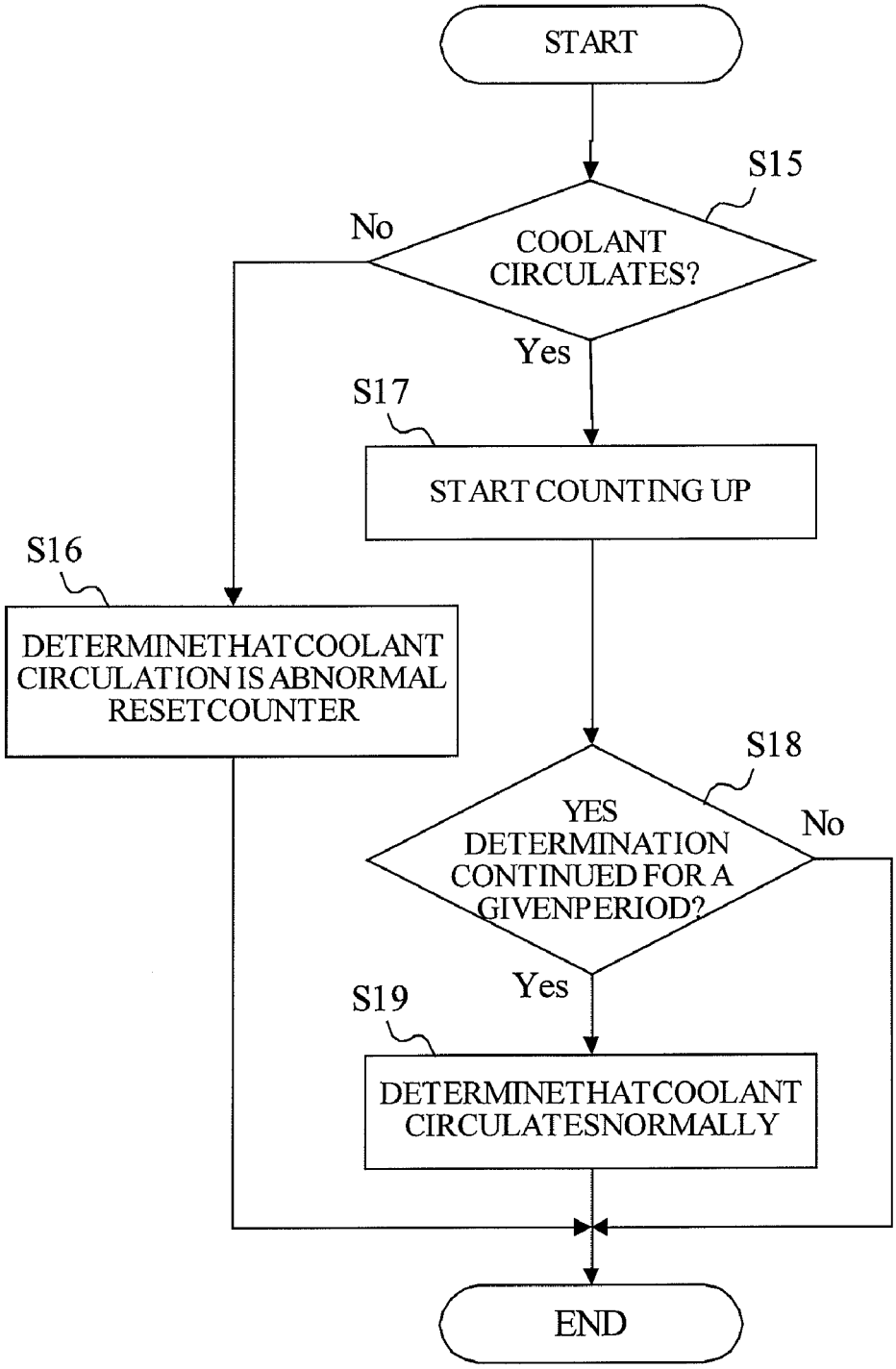
FIG. 13 is a flow chart showing an example of the operation the ECU.

Next, the determination of the coolant circulation performed in step S3 will be described below. FIG. 13 is a flow chart showing an example of the operation of the ECU 11. When YES is determined in step S2, the ECU 11 starts the operation. At first, the ECU 11 determines whether or not the coolant circulates in step S15. Here, it can be determined whether or not the coolant circulates on the basis of the detection result of the current sensor. However, it may be determined on the basis of another detecting portion such as the cooling water temperature. When the coolant circulates (step S15/YES), the ECU 11 advances to step S17. When the coolant does not circulate (step S15/NO), the ECU 11 advances to next step S16.

When the coolant does not circulate, that is, the coolant circulation is abnormal in step S16, the ECU 11 resets the counter. When the ECU 11 finishes the process of step S16, the operation is finished.

When YES is determined in step S15, the ECU 11 proceeds to step S17. In step S17, the ECU 11 starts counting up. When the ECU 11 finishes the process of step S17, the ECU 11 advances to next step S18.

In step S18, the ECU 11 determines whether or not YES determined in step S15 continues for a given period. That process is performed, thereby suppressing the stop of the improvement of the warm-up characteristics caused by the temporal trouble of the coolant circulation. Here, the given period is applicable to an arbitrary period for detecting the coolant temperature with accuracy. When YES determination does not continue during the given period (step S18/NO), the ECU 11 finishes the operation. When YES determination continues during the given period (step S18/YES), the ECU 11 advances to next step S19.

In step S19, the ECU 11 determines that the coolant circulates normally, that is, the coolant circulation is not abnormal. When the ECU 11 finishes the process of step S19, the operation is finished.

Figure 14:
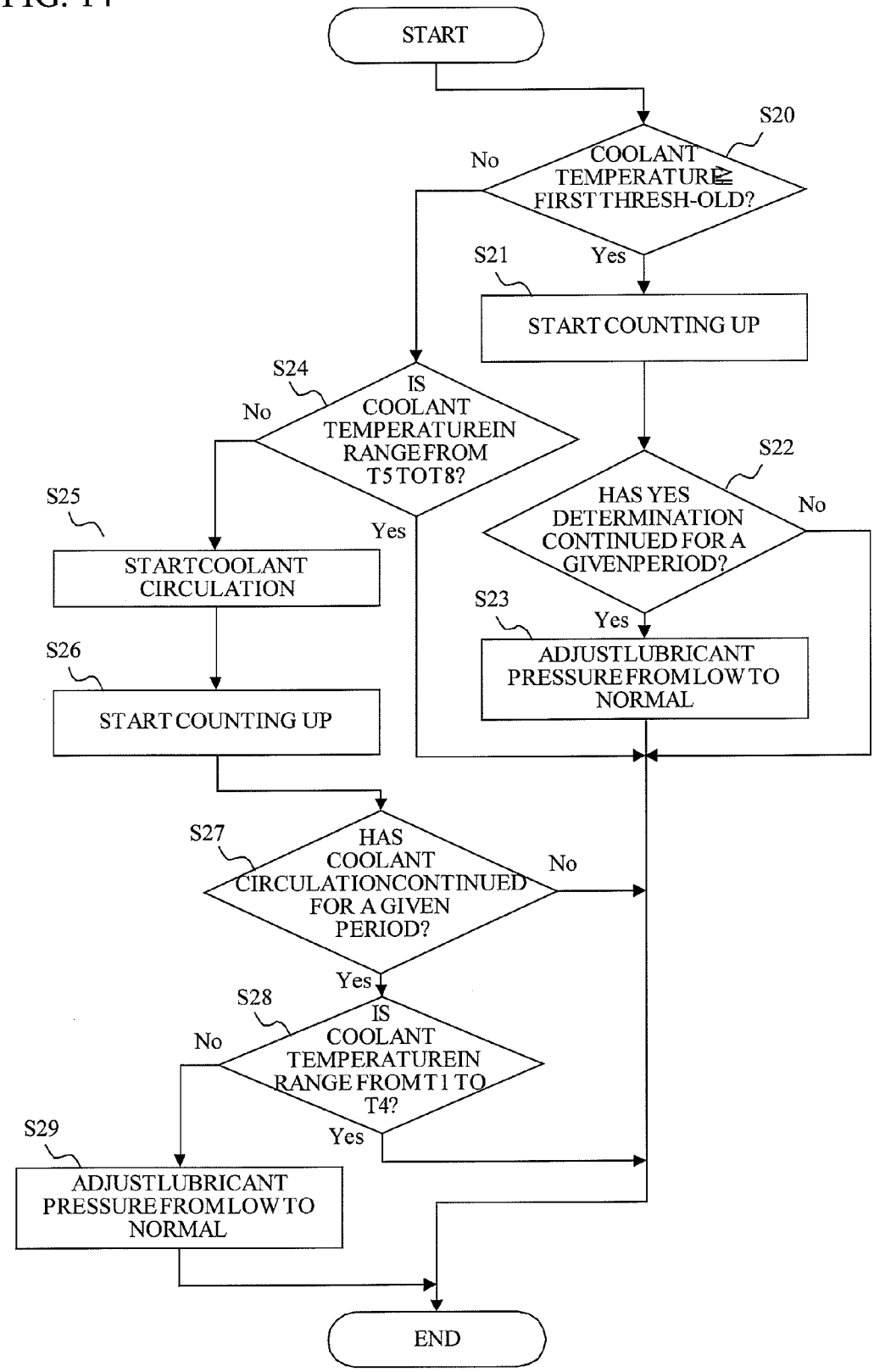
FIG. 14 is a flow chart showing an example of the operation of the ECU.

Next, a description will be given of a flow for determining to stop controlling the improvement of the warm-up characteristics based on the temperature information of the engine 100. FIG. 14 is a flowchart showing an example of the operation of the ECU 11. The ECU 11 starts the operation, when the coolant circulation is stopped or the lubricant pressure is adjusted to low, that is, when the improvement of the warm-up characteristics is controlled. The operation is performed for every given period while the warm-up characteristics is controlled to be improved. At first, in step S20, the ECU 11 determines whether of not the coolant temperature of the engine 100 is equal to or more than the first threshold on the basis of the detection result of the water temperature sensor 31. Here, since the first threshold is mentioned above, its detailed description is omitted. When the coolant temperature is lower than the first threshold (step S20/NO), the ECU 11 advances to step S24. When the coolant temperature is equal to or more than the first threshold (step S20/YES), the ECU 11 advances to next step S21.

In step S21, the ECU 11 starts counting up. When the ECU 11 finishes the process of step S21, the ECU 11 advances to next step S22.

In step S22, the ECU 11 determines whether or not YES determination is continued for a given period. That process is performed, thereby suppressing the stop controlling the improvement of the warm-up characteristics caused by temporary increasing the coolant temperature. Here, the given period is applicable to an arbitrary period for detecting the coolant temperature with accuracy. When YES determination is not continued during the given period (step S22/NO), the ECU 11 finishes the operation. When YES determination is continued during the given period (step S22/YES), the ECU 11 advances to next step S23.

The ECU 11 determines that the sliding portion may be burned in step S23, and instructs the OCV 26 to adjust the lubricant pressure to low. When the ECU 11 finishes the process of step S23, the operation is finished.

When NO is determined in step S20, the ECU 11 proceeds to step S24. In step S24, the ECU 11 determines whether or not the coolant temperature is in a range from T5 to T8 on the basis of the detection result of the water temperature sensor 31. Here, since T5 and T8 have been mentioned above, the detailed descriptions are omitted. When the coolant temperature falls within the range from T5 to T8 (step S24/YES), the ECU 11 finishes the operation. When the coolant temperature does not fall within the range from T5 to T8 (step S24/NO), the ECU 11 advances to next step S25.

In step S25, the ECU 11 determines that a temperature condition for stopping the coolant circulation is not satisfied. The ECU 11 instructs the electromagnetic clutch of the water pump 23 to be disengaged, thereby staring the coolant circulation. When the ECU 11 finishes the process of step S25, the ECU 11 advances to next step S26.

In step S26, the ECU 11 starts counting up. When the ECU 11 finishes the process of step S26, the ECU 11 advances to next step S27.

In step S27, the ECU 11 determines whether or not the cooling circulation started in step S25 is continued for a given period. In this way, the coolant circulation is controlled, thereby detecting the coolant temperature of the engine 100 with accuracy. Thus, the lubricant pressure can be suitably adjusted based on the detected temperature of the engine 100. Here, since the given period has been mentioned above, the detailed description is omitted. When the coolant circulation does not continue during the given period (step S27/NO), the ECU 11 finishes the operation. When the coolant circulation continues during the given period (step S27/YES), the ECU 11 advances to next step S28.

In step S28, the ECU 11 determines whether or not the coolant temperature falls within a range from T1 to T4 on the basis of the detection result of the water temperature sensor 31. Here, since T1 and T4 are mentioned above, the detailed descriptions are omitted. When the coolant temperature falls within the range from T1 to T4 (step S28/YES), the ECU 11 finishes the operation. When the coolant temperature does not fall within the range from T1 to T4 (step S28/NO), the ECU 11 advances to next step S29.

In step S29, the ECU 11 determines that the temperature condition for adjusting lubricant pressure to low is not satisfied. The ECU 11 instructs the OCV 26 to adjust the lubricant pressure from the low pressure to a normal pressure. When the ECU 11 finishes the process of step S29, the operation is finished.

Figure 15:
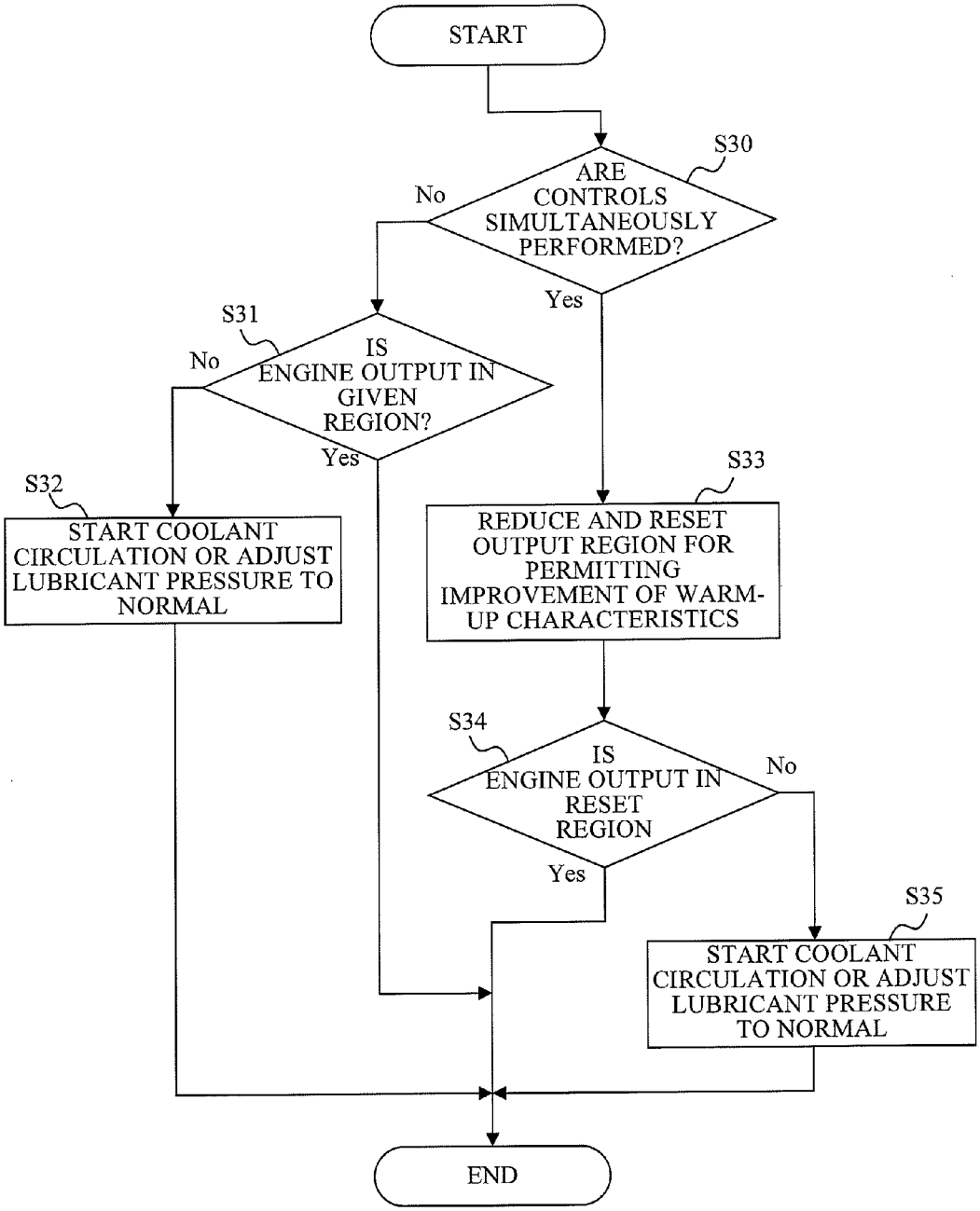
FIG. 15 is a flow chart showing an example of the operation of the ECU.

Next, a description will be given of a flow for determining to stop controlling for improving the warm-up characteristics on the basis of the output information of the engine 100. FIG. 15 is a flow chart showing an example of the operation of The ECU 11. The ECU 11 starts the operation, when the coolant circulation is stopped or the lubricant pressure is adjusted to low, that is, when the warm-up characteristics are improved. The operation is performed for every given period while the warm-up characteristics are improved. At first, in step S30, the ECU 11 determines that whether or not the coolant circulation stops and the lubricant pressure is adjusted to low simultaneously. When the coolant circulation stops and the lubricant pressure is adjusted to low simultaneously (step S30/YES), the ECU 11 advances to step S33. When the coolant circulation stops and the lubricant pressure is adjusted to low non-simultaneously (step S30/NO), the ECU 11 advances to next step S31.

In step S31, the ECU 11 determines whether or not the engine 100 falls within the given output region (see FIG. 8). Here, since the given output region has been mentioned above, the detailed description is omitted. When the engine 100 falls within the given output region (step S31/YES), the ECU 11 determines that the condition for improving the warm-up characteristics is satisfied, and finishes the operation. When the engine 100 does not fall within the given output region (step S31/NO), the ECU 11 advances to next step S32.

In step S32, the ECU 11 determines that the condition for improving the warm-up characteristics is not satisfied, and starts the coolant circulation or stops adjusting the lubricant pressure to low. This can ensure the cooling ability of the engine 100 and suppress the increase in the temperature of each portion, thereby preventing the sliding portion from being burned. When the ECU 11 finishes the process of step S32 and the operation.

When YES is determined in step S30, the ECU 11 proceeds to step S33. In step S33, the ECU 11 changes the rotational number of the engine from N2 to N1, and changes the fuel injection quantity from Q1 to Q2 to set the output region for permitting the warm-up characteristic improvement control again (see FIG. 8). The rotational number and the fuel injection quantity are the references for permitting the coolant circulation to stop and the lubricant pressure to be adjusted to low so as to be simultaneously performed. When the ECU 11 finishes the process of step S33, the ECU 11 continues to next step S34.

In step S34, the ECU 11 determines whether or not the output of the engine 100 falls within the output region set in step S33 again (see. FIG. 8). When the engine 100 is in the output set again (step S34/YES), the ECU 11 determines that the condition for improving the warm-up characteristics is satisfied, and finishes the operation. When the engine 100 does not fall within the output set again (step S34/NO), the ECU 11 advances to next step S35.

In step S35, the ECU 11 determines that the condition for improving the warm-up characteristics is not satisfied, and stop the process for stopping the coolant circulation and the adjustment of the lubricant pressure to low. This can ensure the cooling ability of the engine 100 and can suppress the rapid increase in the temperature of each portion, thereby suppressing the sliding portion from being burned. When the ECU 11 finishes the process of step S35, the operation is finished.

Figure 16:
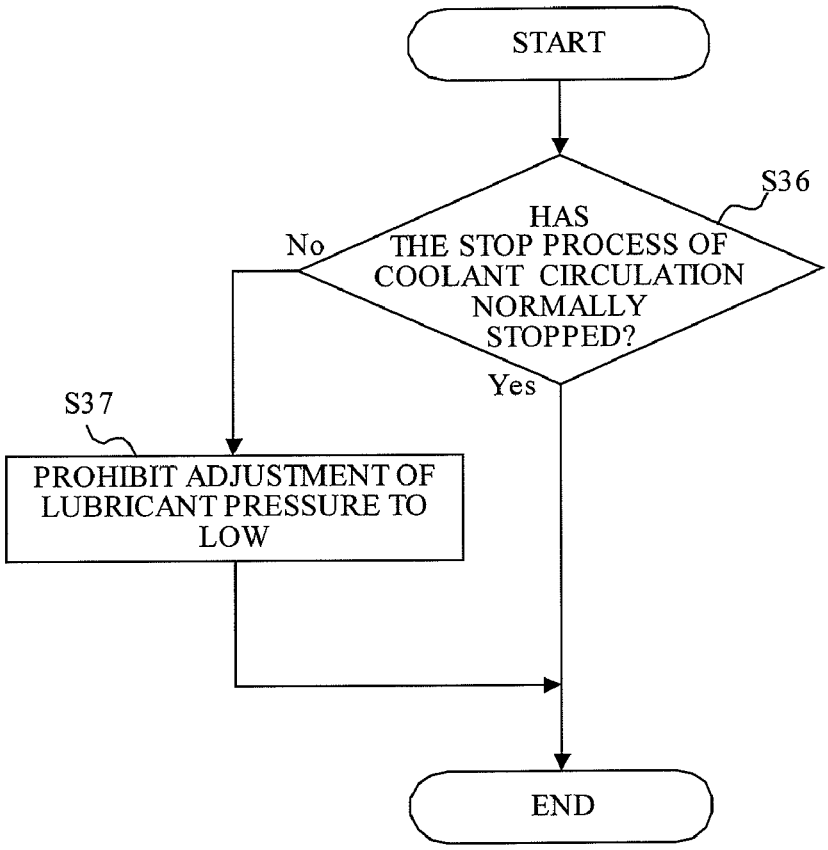
FIG. 16 is a flow chart showing an example of the operation of the ECU.

Next, a description will be given of the flow of prohibiting the adjustment of the lubricant pressure to low at the time the coolant circulation stop system has a failure. FIG. 16 is a flow chart showing an example of the operation of the ECU 11. When the condition for stopping the coolant circulation is satisfied, the ECU 11 performs the control. First, in step S36, the ECU 11 determines whether or not the stop process of the coolant circulation is normally stopped on the basis of the satisfied condition for the control. When the stop process of the coolant circulation stops normally (step S36/YES), the ECU 11 finishes the operation. When the stop process of the coolant circulation does not stop normally (step S36/NO), the ECU 11 advances to next step S37.

In step S37, the ECU 11 prohibits the adjustment of the lubricant pressure to low. Thus, when the stop process of the coolant circulation cannot stop, the adjustment of the lubricant pressure to low is prohibited. This can ensure the cooling ability of the engine 100, thereby suppressing the excessive increase of the temperature of each portion. This can prevent the sliding portion of the engine 100 from being burned, and improve the warm-up characteristics safely. When The ECU 11 finishes the process of step S37, the operation is finished.

Figure 17:
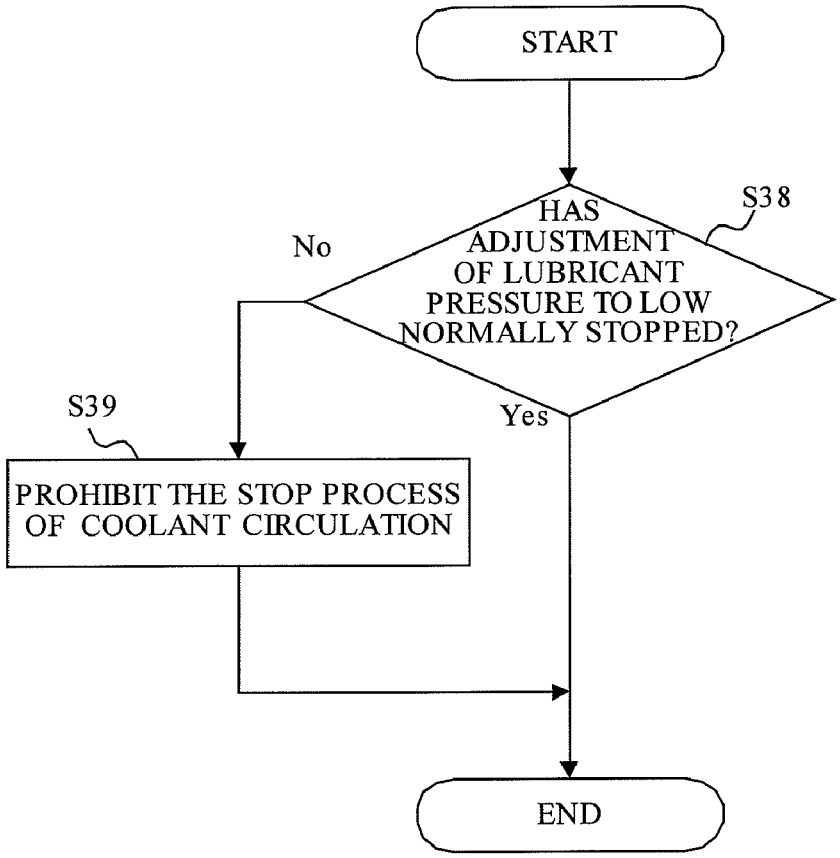
FIG. 17 is a flow chart showing an example of the operation of the ECU.

Next, a description will be given of a flow of prohibiting the stop of the coolant circulation at the time the lubricant pressure switching system has a failure. FIG. 17 is a flow chart showing an example of the operation of the ECU 11. When the condition for stopping the adjustment of the lubricant pressure to low is satisfied, the ECU 11 controls the operation. First, in step S38, the ECU 11 determines whether or not the adjustment of the lubricant pressure to low is normally stopped on the basis of the condition for stopping the operation. When the adjustment of the lubricant pressure to low stops normally (step S38/YES), the ECU 11 finishes the operation. When the adjustment of the lubricant pressure to low does not stop normally (step S38/NO), the ECU 11 advances to next step S39.

In step S39, the ECU 11 prohibits the stop of the coolant circulation. Thus, when the adjustment of the lubricant pressure to low cannot be stopped, the stop of the coolant circulation is prohibited. This can ensure the cooling ability of the engine 100, thereby suppressing the excessive increase in the temperature of each portion. That can suppress the sliding portion of the engine 100 from being burned, and improve the warm-up characteristics safely. When the ECU 11 finishes the process of step S39, the operation is finished.

As mentioned above, the vehicle control system 10 according to the present embodiment includes: the cooling medium circulation stop portion; the low oil pressure adjusting portion; the temperature detecting portion, and the control portion. The control portion determines whether or not the low oil pressure adjusting portion is stopped, on the basis of the results detected by the temperature detecting portion at the time the stop of the cooling medium circulation stop portion is continued for a given period. Therefore, at the time the internal combustion engine is cold, the control is performed with high efficiency by the combination of the stop of the cooling medium circulation and the adjustment of the lubricant pressure to low. This can greatly improve the warm-up characteristics of the internal combustion engine including the cooling medium circulation stop portion and the low oil pressure adjusting portion.

The present invention is not limited to the above-mentioned embodiment, and other embodiments, variations and modifications may be made without departing from the scope of the present invention.

DESCRIPTION OF LETTERS OR NUMERALS

10 Vehicle control system
11 ECU
23 Water pump
24 Oil pump
25 Oil relief device
26 OCV
31 Water temperature sensor
32 Lubricant temperature sensor
100 Engine

The invention claimed is:

1. A control apparatus of an internal combustion engine, comprising:

a cooling medium circulation stop portion stopping circulation of a cooling medium in a cooling medium flow path;

a low oil pressure adjusting portion adjusting an lubricant pressure within a lubricant flow path of the internal combustion engine to lower than a normal oil pressure;

a temperature detecting portion detecting a temperature of the internal combustion engine; and a control portion controlling the cooling medium circulation stop portion and the low oil pressure adjusting portion on the basis of a result detected by the temperature detecting portion;

wherein the control portion determining whether or not the low oil pressure adjusting portion stops, on the basis of the detection result detected by the temperature detecting portion at the time the cooling medium circulation stop portion continuously stops for a given period.

2. The control apparatus of the internal combustion engine of claim 1, wherein:

the control portion permits the cooling medium circulation stop portion and the low oil pressure adjusting portion to stop, only when the output of the internal combustion engine falls within a given region; and the control portion reduces the region where the cooling medium circulation stop portion and the low oil pressure adjusting portion are permitted to operate, while the cooling medium circulation stop portion and the low oil pressure adjusting portion are simultaneously operating.

3. The control apparatus of the internal combustion engine of claim 1, wherein the control portion prohibits the operation of the cooling medium circulation stop portion, when the low oil pressure adjusting portion cannot stop operating.

4. The control apparatus of the internal combustion engine of claim 1, wherein the control portion prohibits the operation of the low oil pressure adjusting portion, when the cooling medium circulation stop portion cannot stop operating.

5. The control apparatus of the internal combustion engine of claim 1, wherein the control portion prohibits the operation of the low oil pressure adjusting portion, when the detection result detected by is equal to or more than a first threshold.

6. The control apparatus of the internal combustion engine of claim 1, wherein the temperature detecting portion detects the temperature of the internal combustion engine on the basis of at least one of the rotational number of the internal combustion engine, a load of the internal combustion engine, a temperature of the cooling medium, and a temperature of the lubricant.

* * * * *